US009567879B2

(12) United States Patent
Sugiura

(10) Patent No.: US 9,567,879 B2
(45) Date of Patent: Feb. 14, 2017

(54) CAM BEARING LUBRICATION STRUCTURE FOR INTERNAL COMBUSTION ENGINE

(71) Applicant: HONDA MOTOR CO., LTD., Tokyo (JP)

(72) Inventor: Hiroyuki Sugiura, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 138 days.

(21) Appl. No.: 14/483,897

(22) Filed: Sep. 11, 2014

(65) Prior Publication Data

US 2015/0090210 A1 Apr. 2, 2015

(30) Foreign Application Priority Data

Sep. 27, 2013 (JP) ..... 2013-201861
Sep. 27, 2013 (JP) ..... 2013-201862

(51) Int. Cl.

| | |
|---|---|
| ***F01M 9/10*** | (2006.01) |
| ***F01L 1/047*** | (2006.01) |
| ***F02F 1/20*** | (2006.01) |
| ***F01M 11/02*** | (2006.01) |
| ***F01L 1/02*** | (2006.01) |
| ***F01L 1/053*** | (2006.01) |
| ***F01L 1/18*** | (2006.01) |
| ***F02B 61/02*** | (2006.01) |

(52) U.S. Cl.

CPC ..... *F01M 9/102* (2013.01); *F01L 1/022* (2013.01); *F01L 1/047* (2013.01); *F01L 1/053* (2013.01); *F01L 1/185* (2013.01); *F01M 11/02* (2013.01); *F02B 61/02* (2013.01); *F02F 1/20* (2013.01); *F01L 2001/0537* (2013.01)

(58) Field of Classification Search

CPC ..... F01M 9/102; F01M 9/10
USPC ..... 123/90.33
See application file for complete search history.

(56) References Cited

U.S. PATENT DOCUMENTS 4,709,667 A * 12/1987 Ichihara ..... F01L 1/053 123/90.27
5,027,762 A * 7/1991 Tokuyama ..... F01L 1/053 123/196 M (Continued)

FOREIGN PATENT DOCUMENTS

JP 3198689 B2 * 8/2001 ..... F01L 1/24
JP 3198689 B2 8/2001
JP 4220415 B2 2/2009

*Primary Examiner* — Zelalem Eshete
(74) *Attorney, Agent, or Firm* — Birch, Stewart, Kolasch & Birch, LLP

(57) ABSTRACT

A cam bearing lubrication structure for an internal combustion engine includes a cylinder head having a cam bearing region, a plug hole for an ignition plug and a plug tube fitted liquid-tight therein. The cam bearing lubrication structure includes an outer periphery oil path bypassing along an outer peripheral face of the plug tube, a main lubricating oil passage extending through the plug hole and formed to connect to the outer periphery oil path and a guide passage formed in and through the cam bearing region to connect a sliding face of the cam bearing region from the outer periphery oil path and supplying lubricating oil to a sliding face of the cam bearing region and a camshaft. In addition, a lubricating oil supplying structure is provided for a valve apparatus for further increasing the oil supply amount to achieve a further increase in the speed of the engine.

17 Claims, 13 Drawing Sheets

(56) References Cited

U.S. PATENT DOCUMENTS

| | | | | |
|---|---|---|---|---|
| 9,151,209 | B2 * | 10/2015 | Higaki | F01L 1/053 |
| 2005/0016484 | A1 * | 1/2005 | Oka | F01L 1/18<br>123/90.36 |

* cited by examiner

CAM BEARING LUBRICATION STRUCTURE FOR INTERNAL COMBUSTION ENGINE

CROSS-REFERENCE TO RELATED APPLICATIONS

The present application claims priority under 35 USC 119 to Japanese Patent Application No. 2013-201861 filed Sep. 27, 2013 and Japanese Patent Application No. 2013-201862 filed Sep. 27, 2013 the entire contents of which are hereby incorporated by reference.

BACKGROUND OF THE INVENTION

1. Field of the Invention

The present invention relates to a lubrication structure to a camshaft of a valve mechanism of an internal combustion engine and to a lubricating oil supplying structure for a valve apparatus of an internal combustion engine.

2. Description of Background Art

In a lubrication path of lubricating oil for camshafts wherein intake and exhaust cams for opening and closing intake and exhaust valves of a valve mechanism of an internal combustion engine are provided, a main lubricating oil passage is provided in a cylinder head. The main lubricating oil passage extends in parallel to and is positioned between an intake camshaft and an exhaust camshaft. Lubricating oil is supplied from an oil pump to the main lubricating oil passage. Since the main lubricating oil passage is disposed between the intake camshaft and the exhaust camshaft, a plug hole in which an ignition plug is fitted is formed for each cylinder between the intake camshaft and the exhaust camshaft and crosses with and divides the main lubricating oil passage. Therefore, an annular tubular member is inserted in the plug hole and mounted liquid-tight in the plug hole above and below the main lubricating oil passage to form a bypassing oil passage on an outer periphery of the plug tube such that the main lubricating oil passage is connected to the oil passage.

Further, a guide passage is formed on the downstream side of the main lubricating oil passage through a communication passage and an extension passage and extends in an upward and downward direction toward a bearing region positioned at an axial end of each camshaft so as to lubricate the bearing region. In addition, although at least a plurality of bearing regions for each camshaft are provided at different locations, if it is tried to provide an oil passage such as a communication passage, an extension passage or a guide passage formed independently of each other at each bearing region, then it is necessary to consider the arrangement space for the oil passages or the workability of a cylinder head. Therefore, there is the possibility that this may cause an increase in the size of the cylinder head. Thus, it is desired to provide a cam bearing lubrication structure for an internal combustion engine that is easy to service while oil passages to different locations are reduced in length. See, for example, Japanese Patent No. 3198689.

As a lubricating oil supplying structure for a valve apparatus of an internal combustion engine, a lubricating oil supplying structure is available wherein a lubricating oil path along which oil is discharged toward a contact region between an adjust bolt and a valve stem from among sliding regions of a rocker arm is provided in the rocker arm. Conventionally, one of such lubricating oil supplying structures for a valve apparatus is disclosed, for example, in Japanese Patent No. 4220415. In the lubricating oil supplying structure for the valve apparatus disclosed in Japanese Patent No. 4220415, a lubrication passage is provided in a rocker arm shaft such that oil is supplied to a sliding face between the rocker arm shaft and a rocker arm from the lubrication passage. The oil supplied from the sliding face is injected from a lubricating oil passage provided in the rocker arm shaft to a contact region between an adjust bolt and a valve stem.

In Japanese Patent No. 4220415, the amount of oil supplied to an ejection port of each rocker arm when oil is branched and shunted to the rocker arm shaft decreases. Further, the lubrication oil to the ejection hole of each rocker arm becomes long. In addition, since part of the oil supplied to the sliding face between the adjust bolt and the valve stem is injected, there is a limit to the assurance of the supply amount of oil. Therefore, where a further fuel supply amount is demanded from an increase in the speed of rotation of an engine, it is necessary to improve the oiling system.

The present invention solves such a subject of the prior art, and it is an object of an embodiment of the present invention to provide a cam bearing lubrication structure wherein the space of an oil passage is prevented from increasing to miniaturize a cylinder head. Thus, miniaturization of an internal combustion engine is achieved while oil passages to bearings for intake and exhaust camshafts are reduced in length. In addition, servicing is facilitated and the fabrication cost is reduced.

In order to attain the object described above, according to an embodiment of the present invention, a cam bearing lubrication structure for an internal combustion engine includes a cylinder head having a cam bearing region on which a camshaft is supported for rotation, a plug hole in which an ignition plug supported on the cylinder head is accommodated such that an end thereof is exposed to a combustion chamber, and a plug tube having a cylindrical shape and fitted liquid-tight at upper and lower end portions thereof in the plug hole to separate the inside of the cylinder head and the plug hole from each other. The cam bearing lubrication structure for the internal combustion engine further includes an outer periphery oil path formed liquid-tight at the upper and lower end portions of the plug tube with respect to the plug hole and bypassing along an outer peripheral face of the plug tube. A main lubricating oil passage extends through the plug hole in the cylinder head and is formed so as to connect to the outer periphery oil path. A guide passage is formed in and through the cam bearing region so as to connect a sliding face of the cam bearing region from the outer periphery oil path and supplying lubricating oil to a sliding face of the cam bearing region and the camshaft.

According to an embodiment of the present invention, an outlet of the guide passage to the cam bearing region is provided on a semicircular face at the plug hole side with respect to the center of rotation of the camshaft.

According to an embodiment of the present invention, the cam bearing region is configured from a plurality of divisional halves. A threaded hole, provided between the camshaft and the plug hole and used for a fastening member which couples the divisional half, is formed such that the guide passage extends therethrough. The threaded hole is sealed by the fastening member.

According to an embodiment of the present invention, the cam bearing region is configured from divisional upper and lower halves with the guide passage being formed by working in such a manner so as to be inclined with respect to a mating plane of the upper and lower halves toward the plug hole.

According to an embodiment of the present invention, the cylinder head has a plurality of camshafts provided thereon sandwiching the plug hole therebetween with a pair of guide passages being formed for each of the cam bearing regions.

According to an embodiment of the present invention, a protuberance is provided at a position below an upper end face of the plug tube and between the position of an inlet of the guide passage in such a manner as to protrude annularly from an outer periphery of the plug tube.

According to an embodiment of the present invention, a holder unit is disposed at an upper end face of the upper end portion of the plug tube so as to closely contact with the upper end face to fix the plug tube from coming off from above with an annular seal member interposed therebetween.

According to an embodiment of the present invention, the cam bearing region is configured from upper and lower halves formed as upper and lower divisional portions, and the holder unit is configured integrally with the upper half.

According to an embodiment of the present invention, the upper and lower end portions of the plug tube are fitted liquid-tight in the plug hole to form the outer periphery oil path. The guide passage is formed from the outer periphery oil path in such a manner so as to connect the cam bearing region. Consequently, oil is directly supplied from the outer periphery oil path to the cam bearing region through the guide passage. Thus, the oil passage to the cam bearing region can be reduced in length, and as a result, it is possible to reduce the size of the cylinder head to achieve miniaturization of the internal combustion engine.

According to an embodiment of the present invention, the outlet of the guide passage from the outer periphery oil path is provided on the semicircular face of the cam bearing region at the plug hole side. Therefore, it is possible to reduce the length of the guide passage to the utmost and reduce the time for oil supply to the cam bearing region after the internal combustion engine is started up.

According to an embodiment of the present invention, the guide passage is formed so as to extend through the threaded hole between the camshaft and the plug hole, and the guide passage is sealed by the fastening member. Therefore, in comparison with an alternative case in which the guide passage is formed bypassing the threaded hole, the guide passage can be connected in the shortest length, and it is possible to reduce the working cost.

According to an embodiment of the present invention, the cam bearing is formed from upper and lower halves, and when the guide passage is formed by working from the bearing formed as the two divisional upper and lower portions, by working the cam bearing region obliquely, the working procedure can be carried out readily.

According to an embodiment of the present invention, the supply of oil to the cam bearing regions at the opposite sides sandwiching the plug hole can be carried out from the outer periphery oil path of the common plug hole. Thus, the oil supply path can be simplified.

According to an embodiment of the present invention, the annular protuberance is provided on the outer periphery of the plug tube at a position above the inlet of the guide passage. Therefore, the flow of oil, which has flowed from below into and flowed upwardly in the outer periphery oil path into the inlet of the guide passage, can be promoted to facilitate the supply of the oil into the guide passage.

According to an embodiment of the present invention, the upper end face of the plug tube, which configures part of the outer periphery oil path, is fixed from coming off from above by the holder unit through the annular seal member. Therefore, the plug tube which is acted upon by hydraulic pressure and is likely to come off can be suppressed with certainty.

According to an embodiment of the present invention, the cam bearing region is configured from the upper and lower halves formed as upward and downward divisional portions. When the holder unit is provided, by forming the holder unit integrally with the upper half of the cam bearing region a reduction in the number of parts can be anticipated. Thus, a reduction in the fabrication cost can be anticipated.

In addition, it is an object of an embodiment of the present invention to provide a lubricating oil supplying structure for a valve apparatus of an internal combustion engine wherein the oil supplying amount is further increased in accordance with an increase in the speed of rotation of the engine.

According to an embodiment of the present invention, a lubricating oil supplying structure for a valve apparatus of an internal combustion engine having a cylinder head which supports camshafts for rotation thereon includes, for each pair of engine valves for intake and exhaust, rocker arms supported at pivotally supporting base portions thereof for rocking motion by rocker arm shafts. The rocker arms are interposed between valve stem axial ends of the engine valves and cam faces of the camshafts to allow contact therebetween. Pressing force from the cam faces acting upon the rocking arms is transmitted to the valve stems to open and close the engine valves. The lubricating oil supplying structure for the valve apparatus includes an oil passage provided in the cylinder head along an axial direction of the camshafts and formed from a single passage at a position lower than the rocker arm shafts between the intake and exhaust valves. A pair of oil injection oil paths is formed so as to be directed independently for the individual rocker arms from the oil passage.

According to an embodiment of the present invention, valve stem pressing portions are formed at locations at which the rocker arms contact with the valve stems side in a continuous relationship to lower faces of the rocking arms of the rocker arms. The direction in which the oil injection oil paths are directed to the rocker arms is directed toward the lower faces of the rocking arms.

According to an embodiment of the present invention, the lower face of the rocker arm is formed wherein a curved recessed portion is the lowest portion toward the valve stem pressing portion.

According to an embodiment of the present invention, clearance adjustment members for adjusting gaps between the valve stem axial ends and the rocker arms are formed exchangeably as separate members between the valve stems and the valve stem pressing portions of the rocker arms.

According to an embodiment of the present invention, the oil passage is provided in a protuberance protruding from a lower face of a connecting bottom wall which interconnects lower portions of a pair of support walls which are provided on the cylinder head and support the opposite axial ends of the rocker arm shaft.

According to an embodiment of the present invention, the camshafts are configured independently as an intake camshaft and an exhaust camshaft and disposed at a position above the rocker arms, and sliding portions between the rocker arms and the cam faces are provided on upper faces of the rocker arms.

According to an embodiment of the present invention, the rocker arm shafts are disposed between the intake and exhaust camshafts such that the sliding portions of the rocker arms are disposed so as to be directed outwardly relative to each other. The rocker arm shafts are disposed at heightwise positions different from each other with reference to an extension line of the cylinder center axis. The oil passage is disposed in an offset relationship to the rocker arm shaft disposed at the higher position.

According to an embodiment of the present invention, a cylinder of the internal combustion engine is mounted in an inclined relationship with respect to the vertical direction such that, in a state in which the internal combustion engine is mounted on a vehicle. A tip end of the rocker arm disposed on one of the two rocker arm shafts, which is disposed at the higher position, is directed obliquely upwardly while a tip end of the rocker arm disposed on the other one of the two rocker arm shafts, which is disposed at the lower position, is directed obliquely downwardly. The oil injection oil path is formed such that the injection direction from the oil injection oil path to the valve stem pressing portion of that one of the rocker arms in which the oil passage is disposed in an offset relationship is directed to the tip end of the rocker arm. The oil injection oil path is formed such that the injection direction from the oil injection oil path to the valve stem pressing portion of the other rocker arm is directed to the pivotally supporting base portion of the rocker arm.

According to an embodiment of the present invention, the oil passage is formed from the single passage extending along the camshafts at a position lower than the rocker arm shafts between the intake and exhaust valves, and the paired oil injection oil paths are provided so as to be directed independently of the individual rocker arms from the oil passage. Therefore, while the path for the injection oil is reduced in length, oil is supplied from the single oil passage directly to the rocker arms, and oil to be supplied to the oil injection oil paths is supplied from the common oil passage. Consequently, it is possible to facilitate assurance of the amount of oil. Further, since the oil injection oil paths are provided from the single oil passage, space saving of the lubricating oil supplying structure can be anticipated. Thus, the fabrication cost can be reduced.

According to an embodiment of the present invention, the lower faces of the rocking arms of the rocker arms are formed in a continuous relationship to the valve stem pressing portions. Thus, the direction in which the oil injection oil paths are directed to the rocker arms is directed toward the lower faces of the rocking arms. Therefore, even if part of the injected oil does not directly reach the valve stem pressing portions, it flows along the lower faces of the rocking arms and is supplied to the valve stem pressing portions. Consequently, the oil supplying amount to the valve stem pressing portions can be increased.

According to an embodiment of the present invention, the lower face of the rocker arm is formed as a curved recessed portion which is the lowest portion toward the valve stem pressing portion. Therefore, oil sticking to the lower face can positively flow to the sliding portion side between the valve stem pressing portion and the valve stem axial end to collect the oil.

According to an embodiment of the present invention, the clearance adjustment members are formed as separate members between the valve stem pressing portions of the rocker arms and the valve stem axial ends. Therefore, the necessity for such a screw adjustment mechanism disposed at a tip end of a rocker arm as in a conventional technology is eliminated. Further, since the sliding faces of the valve stem pressing portions are configured from curved faces, it becomes possible to supply oil flowing along the lower faces of the rocker arms with certainty to the sliding faces of the valve stem pressing portions.

According to an embodiment of the present invention, the oil passage is provided in the connecting bottom wall of the paired support walls which support the opposite axial ends of the rocker arm shaft and this is provided in the protuberance protruding from the lower face. Therefore, the oil passage can be provided in the cylinder head. Thus, an increase in the size of the cylinder head in the heightwise direction can be suppressed.

According to an embodiment of the present invention, the sliding portions are provided on the upper faces of the rocker arms. Therefore, the injected oil can be supplied to the valve stem side end portions without being obstructed by cam lobes of the camshafts.

According to an embodiment of the present invention, where the intake and exhaust rocker arm shafts are disposed closely to each other, they are disposed differently from each other in the cylinder axial direction, and the oil passage is disposed in an offset relationship to the rocker arm shaft side disposed at the higher position. Therefore, the free space can be utilized effectively to compactly dispose the oil passage.

According to an embodiment of the present invention, the internal combustion engine is mounted on the vehicle such that the tip ends of the two rocker arms are directed obliquely upwardly and obliquely downwardly, and the oil injection oil path to the rocker arm disposed at the higher position is formed so as to be directed to the tip end of the rocker arm while the oil injection oil path to the rocker arm disposed at the lower position is formed so as to be directed to the pivotally supporting base portion of the rocker arm shaft. Therefore, even where it is difficult to direct an oil injection oil path directly to the tip end of the rocker arm, it is possible to allow oil to flow and be supplied to the tip end of the rocker arm from the pivotally supporting base portion of the rocker arm. Consequently, while a reduction of the length of the oil injection oil path is achieved, oil supply can be carried out with certainty.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

In the following, a cam bearing lubrication structure and a lubricating oil supplying structure for a valve apparatus of an internal combustion engine according to an embodiment of the present invention depicted in FIGS. 1 to 9 is described. In the present embodiment, forward and rearward, upward and downward, and leftward and rightward directions signify the front and rear, up and down, and left and right of a vehicle body not depicted in which the internal combustion engine is incorporated.

Figure 1:
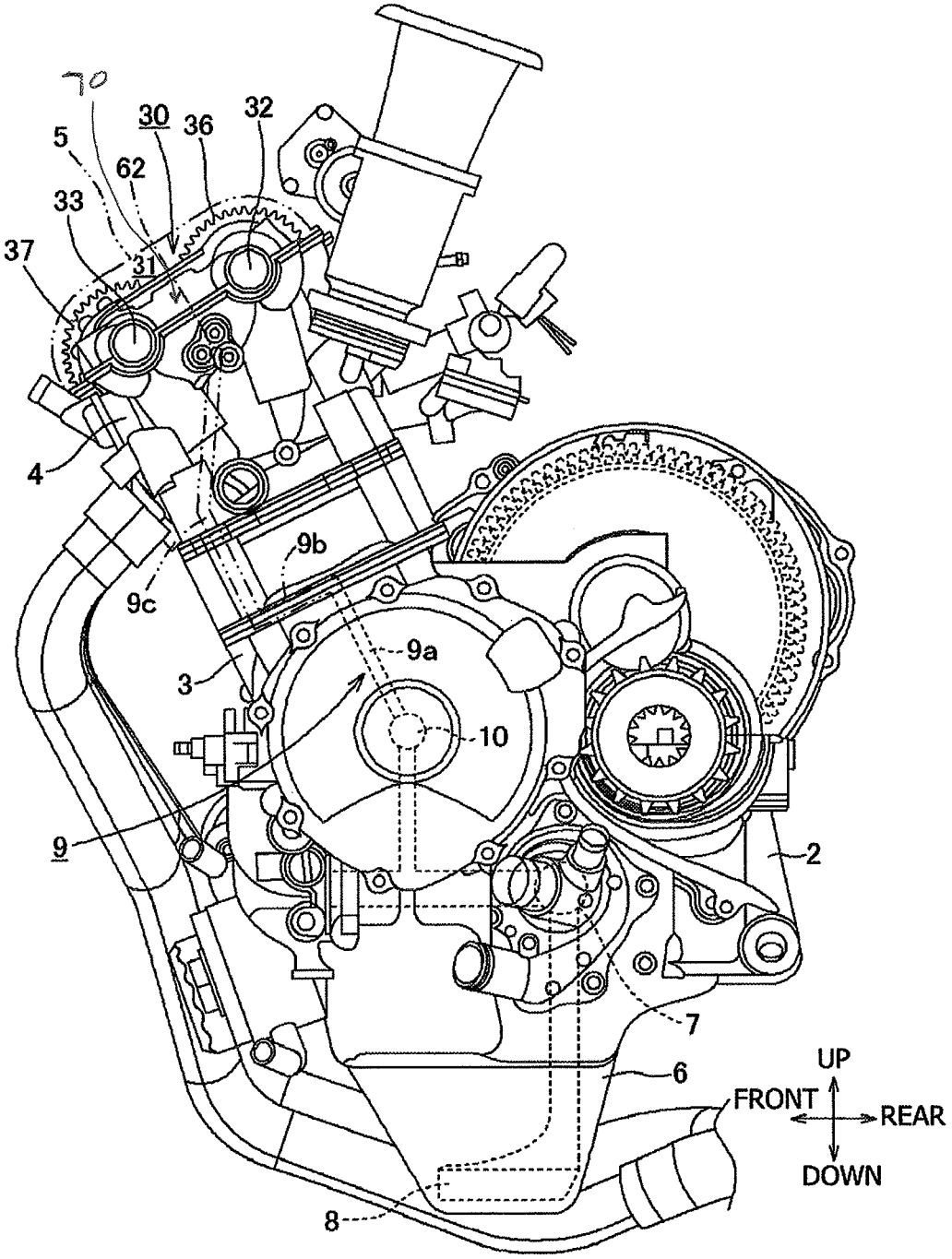
FIG. 1 is a left side elevational view of an internal combustion engine of an embodiment of the present invention which includes a cam bearing lubrication structure for an internal combustion engine.
Figure 2:
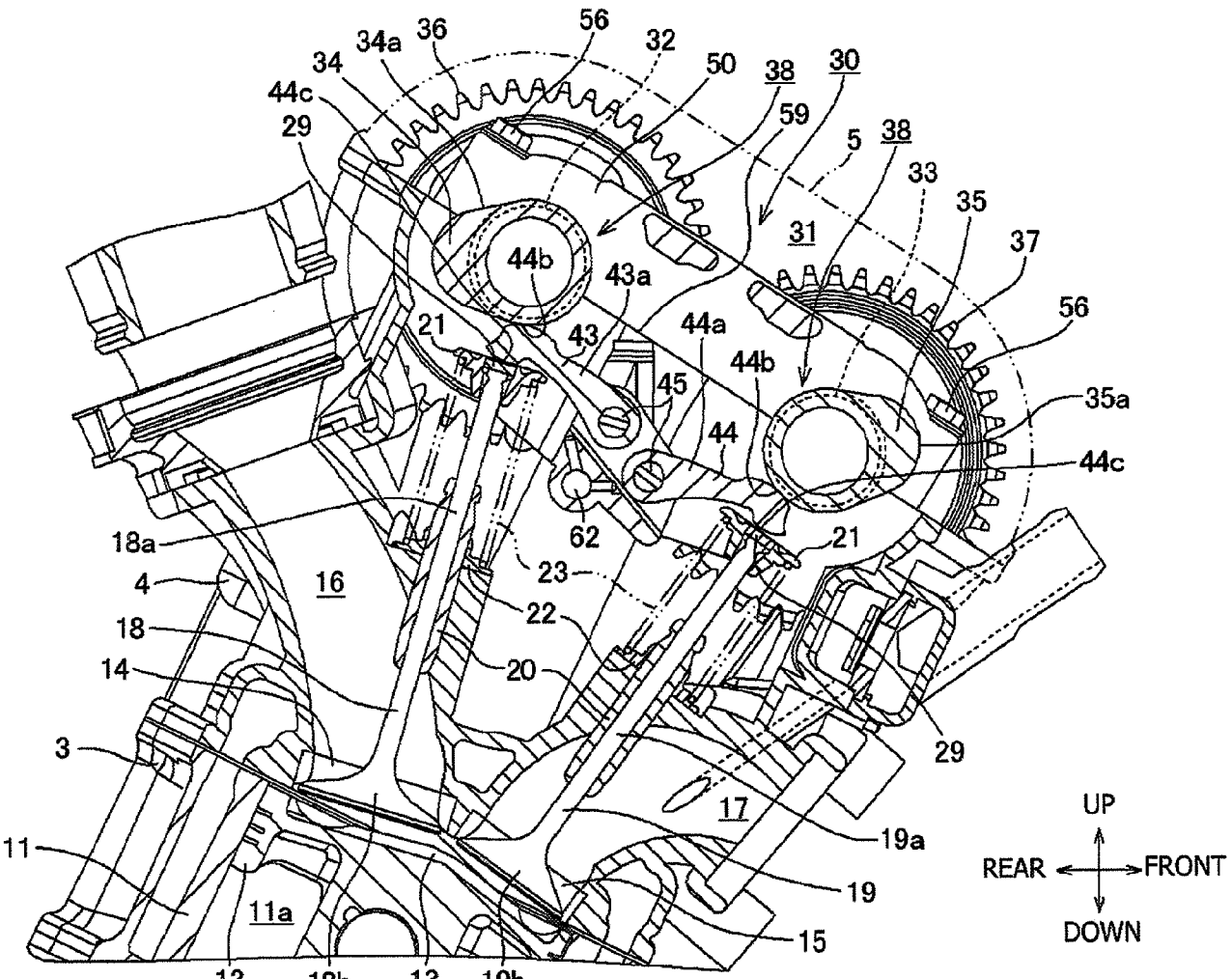
FIG. 2 is a vertical sectional view of the internal combustion engine taken along a plane passing a center line of an intake valve and a center line of an exhaust valve.
Figure 3:
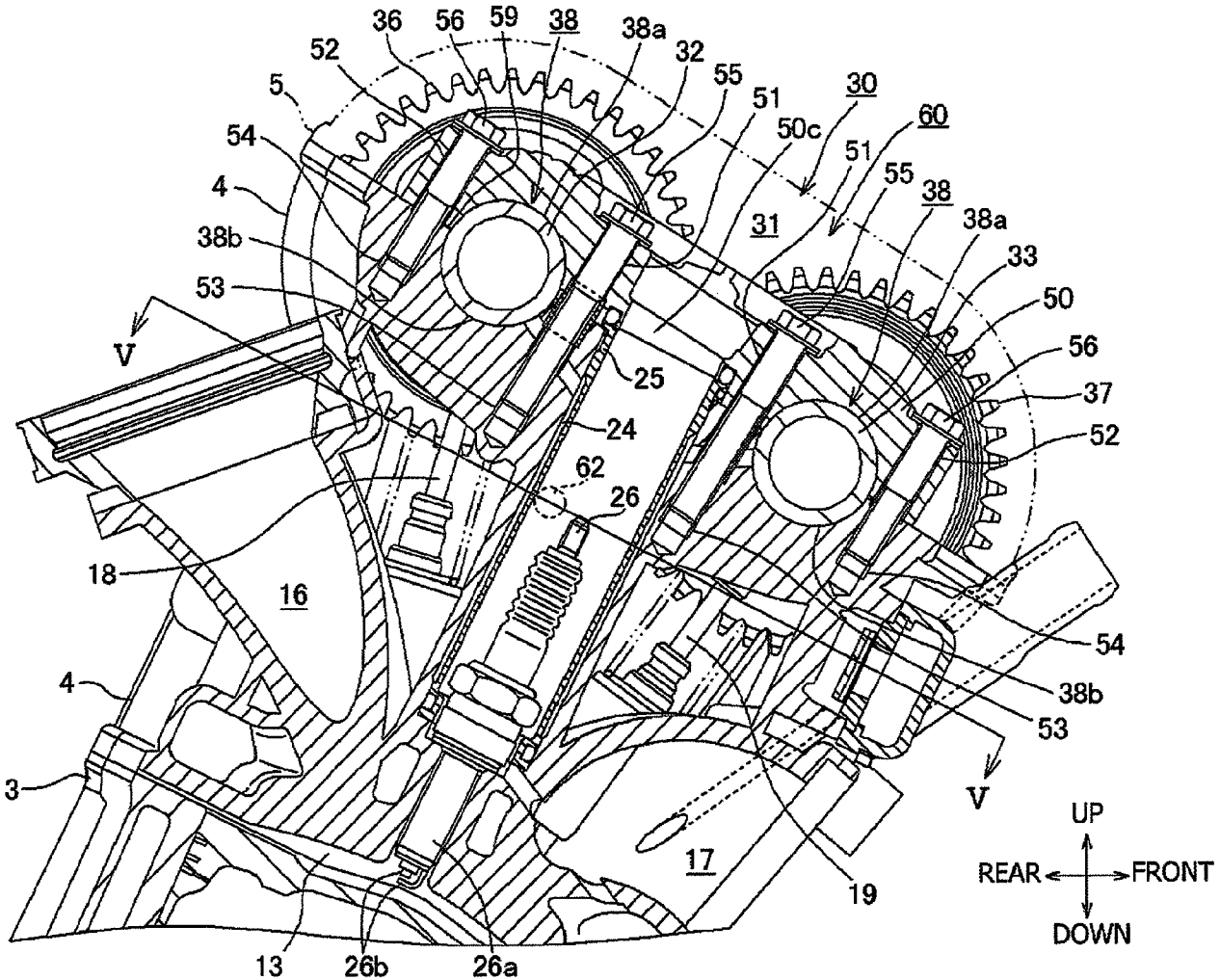
FIG. 3 is a vertical sectional view of the internal combustion engine taken along a plane passing a center line of a combustion plug tube.
Figure 4:
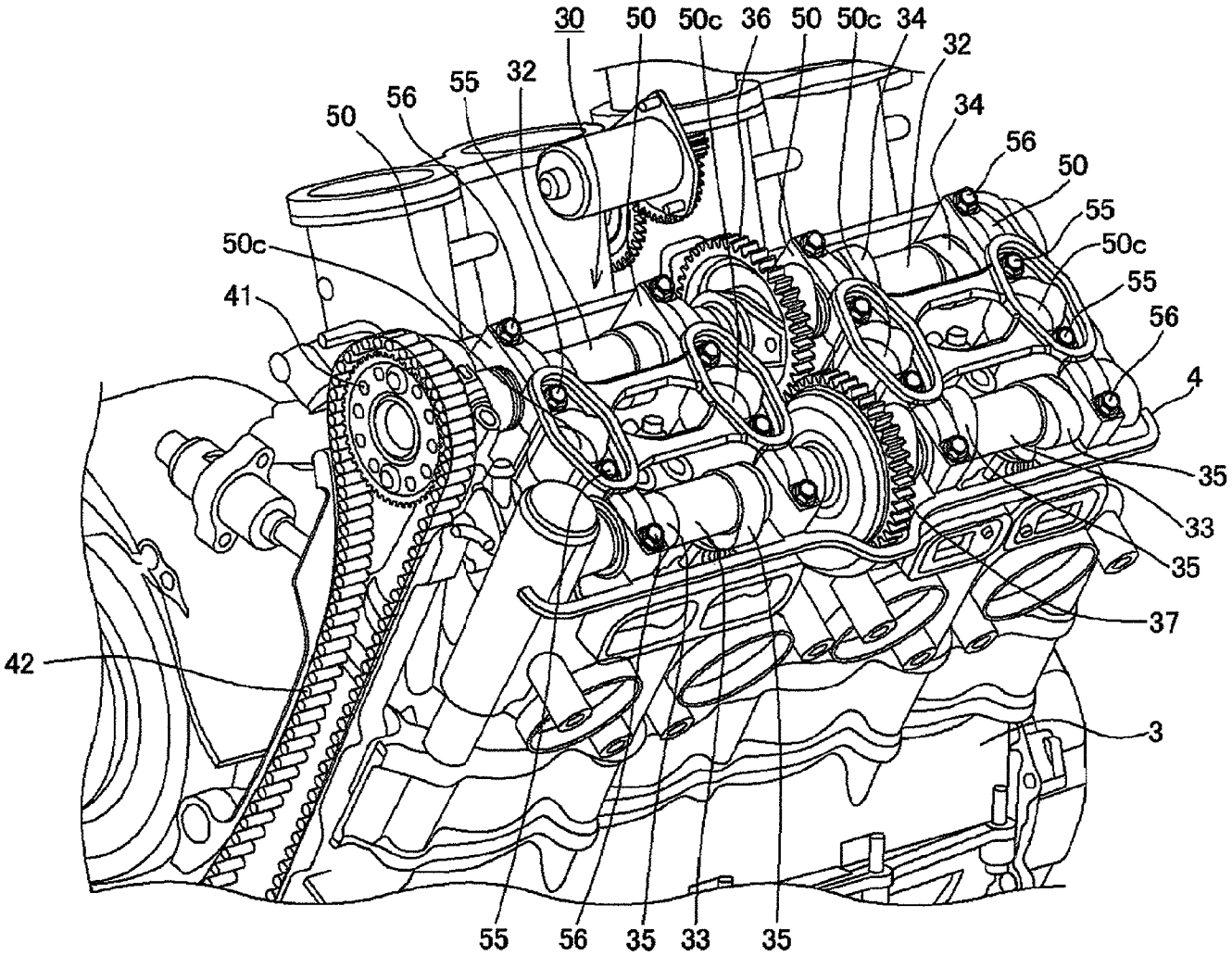
FIG. 4 is perspective view of the internal combustion engine with a head cover removed.

FIG. 1 is a side elevational view when an internal combustion engine 1 which includes a lubrication structure 60 for a cam bearing and a lubrication structure 70 for a valve apparatus of an embodiment of the present invention is viewed from the left. The internal combustion engine 1 includes a cylinder block 3, a cylinder head 4, and a head cover 5 stacked one on another on a crankcase 2 and fastened integrally by bolts not depicted. An oil pan 6 is fastened to a lower face of the crankcase 2 by bolts not depicted. The internal combustion engine 1 is a four-cylinder series type internal combustion engine wherein four cylinders 11 are formed in the leftward and rightward direction in the cylinder block 3. As depicted in FIGS. 2 to 4, a valve mechanism 30 of a four-valve system of the DOHC type which drives intake valves 18 and exhaust valves 19 to open and close is accommodated in a valve chamber 31 configured from the cylinder head 4 and the head cover 5.

As depicted in FIG. 1, a crankshaft 10 is supported for rotation between the crankcase 2 and the cylinder block 3 such that it is directed in the leftward and rightward direction. As depicted in FIG. 2, a piston 12 is fitted in each of the cylinders 11 formed in the cylinder block 3 such that it slidably moves upwardly and downwardly. The piston 12 is connected to the crankshaft 10 through a connecting rod not depicted. A combustion chamber 13 configured from a recess is formed in the cylinder head 4 at a position opposing to a cylinder hole 11*a* of each cylinder 11. By explosion of fuel combusted in the combustion chamber 13, the piston 12 is slidably moved in the upward and downward directions in the cylinder 11, and the crankshaft 10 is driven to rotate by the upward and downward movement of the piston 12.

For each combustion chamber 13, two inlets 14 and two outlets 15 are formed, and an intake port 16 for introducing intake air into the combustion chamber 13 and an exhaust port 17 for exhausting exhaust air generated in the combustion chamber 13 are communicated with the inlets 14 and the outlets 15, respectively. An intake valve 18 and an exhaust valve 19 for opening and closing the inlet 14 and the outlet 15 are supported for sliding movement by valve guides 20. The intake valves 18 and the exhaust valves 19 are normally biased in a valve closing direction by springs 23 fitted between upper retainers 21 fixed to an upper end of valve stems 18*a* and 19*a* and lower retainers 22 fixed to the cylinder head 4.

As depicted in FIGS. 3 and 5 to 7, an ignition plug tube 25 is fitted at a position substantially centrally of the inlets 14 and the outlets 15 of one cylinder of the cylinder head 4. The ignition plug tube 25 is fitted in an ignition plug hole 24, and an ignition plug inserted in the ignition plug tube 25 is attached to the ignition plug hole 24.

Figure 6:
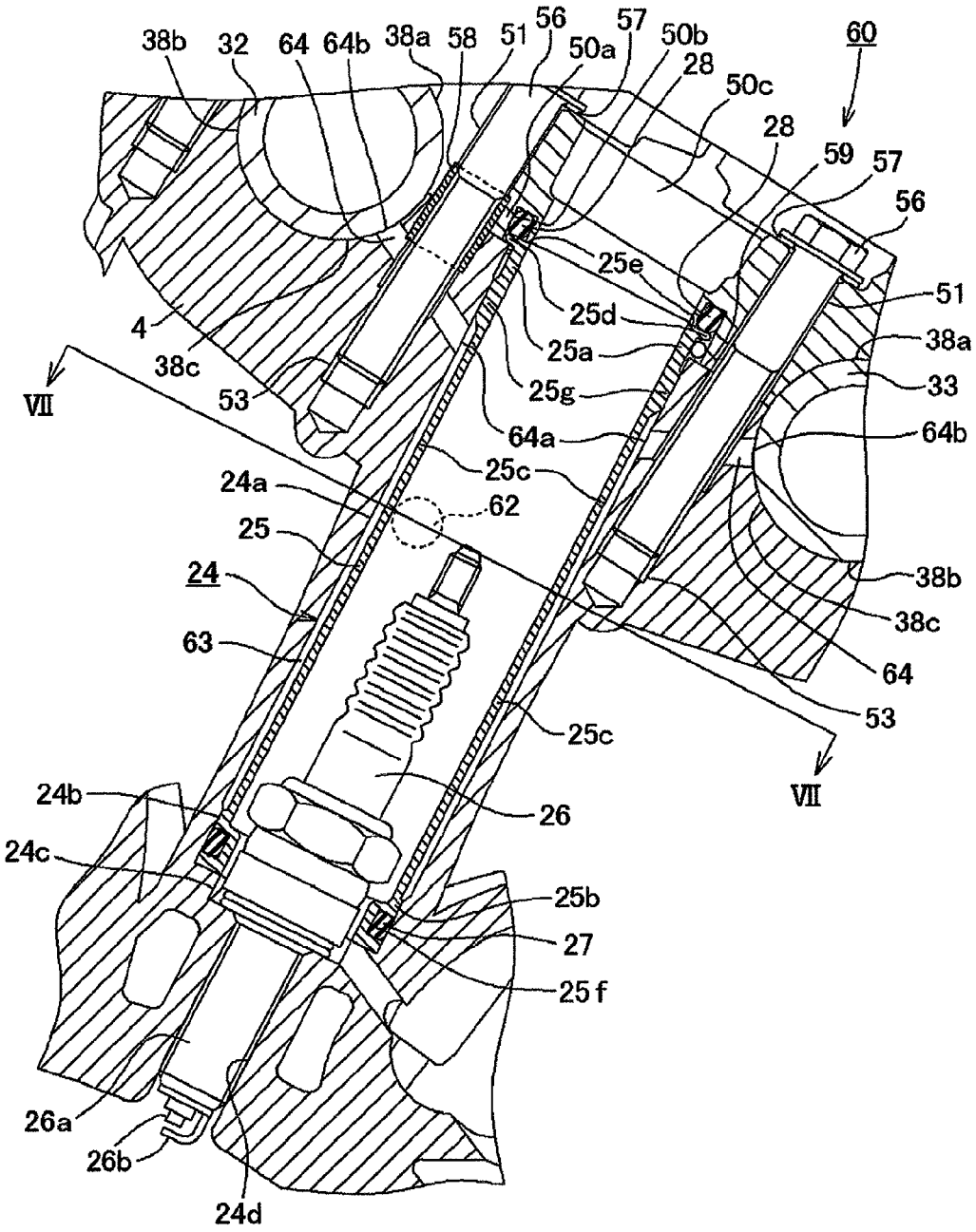
FIG. 6 is a partial enlarged sectional view of FIG. 3.

The ignition plug hole 24 is formed from a plurality of coaxial round holes having different inner diameters from each other as depicted in FIG. 6. A main plug hole 24*a* is formed downwardly from a mating plane 59 between an upper face of the cylinder head 4 and a camshaft holder 50. A plug tube fitting portion 24*b* is formed continuously to a lower portion of the main plug hole 24*a*. The plug tube fitting portion 24*b* has a rather small inner diameter, and an end portion 25*a* of the ignition plug tube 25 is inserted in the plug tube fitting portion 24*b*. An ignition plug abutting portion 24*c* having a smaller inner diameter is formed in a communicating relationship with a lower portion of the plug tube fitting portion 24*b*. A threaded portion 24*d* is formed in a communicating relationship with a lower portion of the ignition plug abutting portion 24*c*, and a threaded portion 26*a* of an ignition plug 26 is screwed with the threaded portion 24*d*. The threaded portion 26*a* is communicated at an end thereof with the combustion chamber 13.

The ignition plug tube 25 is inserted in the ignition plug hole 24. The ignition plug tube 25 has a cylindrical shape, and a cylindrical intermediate portion 25*c* which occupies almost all of the ignition plug tube 25 has an outer diameter smaller than the inner diameter of the main plug hole 24*a* of the ignition plug hole 24. A flange portion 25*d* is provided at the upper end portion 25*a* of the ignition plug tube 25 and is formed with a diameter greater than the inner diameter of the main plug hole 24*a*. A lower end portion 25*b* of the ignition plug tube 25 is fitted in the plug tube fitting portion 24*b* of the ignition plug hole 24, and a grooved portion 25*f* is formed at the lower end portion 25*b* such that an annular seal member 27 is fitted into the grooved portion 25*f*.

The ignition plug tube 25 is fixed by the camshaft holder 50 hereinafter described so that it does not come off upwardly. An abutting portion 50*a* is formed on the camshaft holder 50 such that it is abutted with the flange portion of the ignition plug tube 25. A grooved portion 50*b* is formed at the abutting portion 50*a* such that an annular seal member 28 is fitted therein. Further, a plug hole 50*c* is formed on the camshaft holder 50 such that it communicates with the inside of the ignition plug tube 25 and an ignition plug is inserted in the plug hole 50*c*.

The ignition plug tube 25 is inserted in the ignition plug hole 24 in a state in which the annular seal member 27 is fitted in the grooved portion 25*f* of the lower end portion 25*b* and is fixed from coming off from above by the camshaft holder 50 having the grooved portion 50*b* in which the annular seal member 28 is fitted. When the ignition plug tube 25 is fixed, a space (plug tube outer periphery oil path 63 hereinafter described) configured from an inner circumferential face of the ignition plug hole 24 and an outer circumferential face of the ignition plug tube 25 is held liquid-tight at the upper end portion 25*a* and the lower end portion 25*b* of the ignition plug tube 25 by the annular seal members 27 and 28. Thus, the inside of the cylinder head 4 and the ignition plug hole 24 are partitioned by the ignition plug tube 25

After the ignition plug tube 25 is fixed from coming off the cylinder head 4 by the camshaft holder 50, the ignition plug 26 is inserted into the ignition plug tube 25 through the plug hole 50*c* of the camshaft holder 50. Then, the threaded portion 26*a* formed at an end of the ignition plug 26 is screwed into the threaded portion 24*d* of the ignition plug hole 24 and attached such that an electrode portion 26*b* of the ignition plug 26 is exposed to the combustion chamber 13.

In the valve chamber 31, an intake camshaft 32 and an exhaust camshaft 33 are disposed in parallel to each other in the forward and rearward direction in such a manner that they are directed in the leftward and rightward direction of the internal combustion engine 1 and sandwich the ignition plug hole 24 therebetween. The intake camshaft 32 and the exhaust camshaft 33 are each supported by a cam bearing 38, which is configured from a lower bearing region 38*b* as a bearing half formed on the cylinder head 4 and an upper bearing region 38*a* as another bearing half formed on the camshaft holder 50.

As depicted in FIGS. 3 and 4, for each ignition plug hole 24, two front bolt threaded holes 53 and two rear bolt threaded holes 54 are disposed on the cylinder head 4. The bolt threaded holes 53 and the bolt threaded holes 54 are formed at positions sandwiching the lower bearing region 38*b*. On the camshaft holder 50, two front bolt insertion holes 51 and two rear bolt insertion holes 52 are disposed for the ignition plug hole 24 corresponding to the bolt threaded holes 53 and 54 formed in the cylinder head. The bolt insertion holes 51 and the bolt insertion holes 52 are formed at positions sandwiching the upper bearing region 38*a*.

Figure 8:
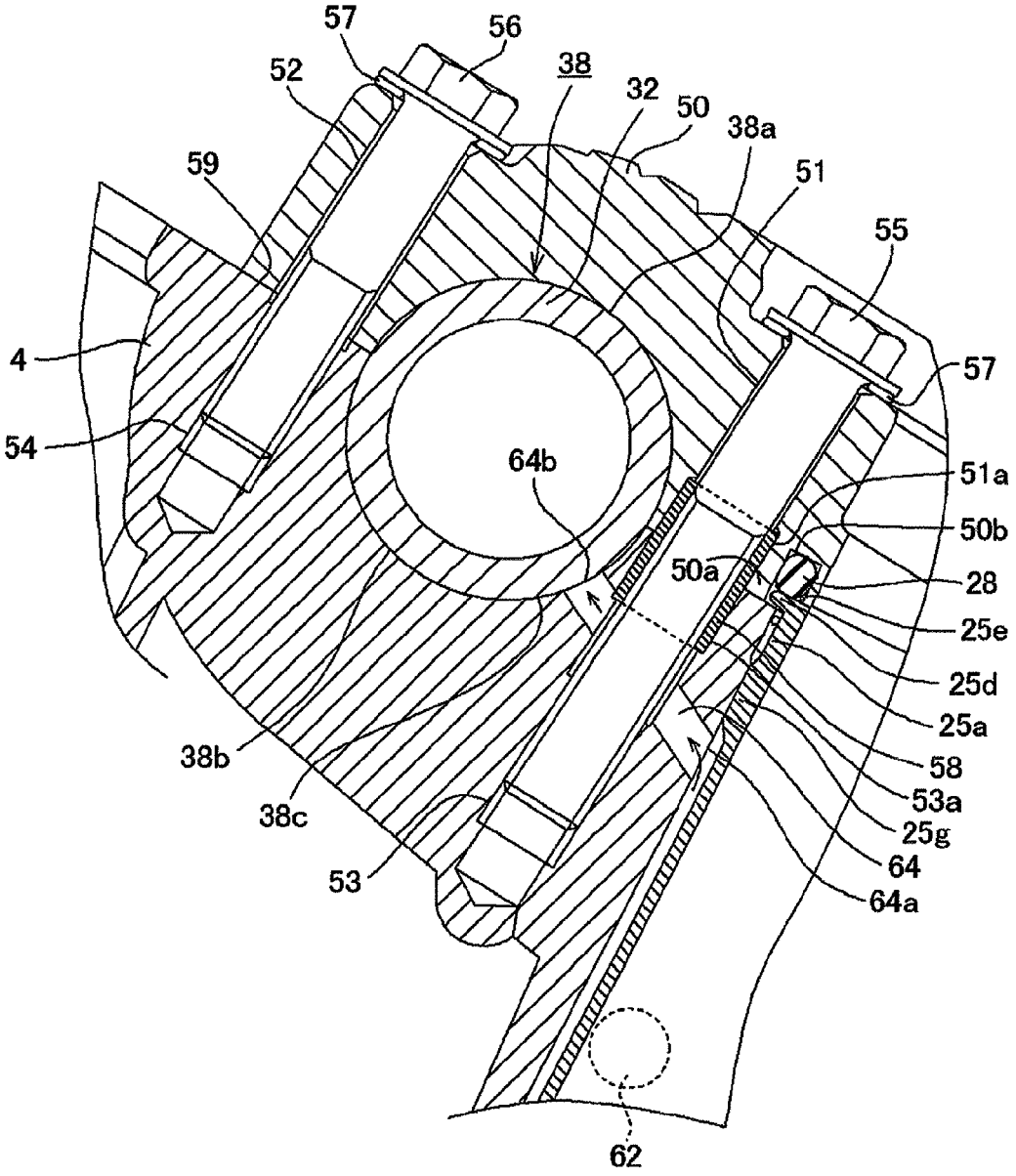
FIG. 8 is a partial enlarged sectional view of FIG. 3.

As depicted in FIG. 8, tubular member insertion holes 51*a* and 53*a* are formed at a lower portion of the bolt insertion hole 51 and an upper portion of the bolt threaded hole 53 on the intake camshaft 32 side and have an inner diameter a little greater than the inner diameters of them. A tubular member 58 is fitted in the tubular member insertion holes 51*a* and 53*a* and formed such that a flange bolt 55 is fitted therein.

The ignition plug tubes 25 are inserted into the ignition plug holes 24 formed on the cylinder head 4, and the intake camshaft and the exhaust camshaft are placed at predetermined positions on the lower bearing region 38*b* formed on the cylinder head. Thereafter, the camshaft holder 50 is fitted in such a manner so as to sandwich the intake camshaft and the exhaust camshaft. The flange bolts 55 and 56 are fitted into the bolt insertion holes 51 and 52 of annular seal members 57 and the camshaft holder 50. Then, the flange bolts 55 and 56 are screwed into the bolt threaded holes 53 and 54 of the cylinder head 4 to fasten the camshaft holder 50 integrally to the cylinder head 4 while the intake camshaft 32 and the exhaust camshaft 33 are supported for rotation on the cam bearings 38. Since the annular seal members 57 are interposed between the flange bolts 55 and 56 and the camshaft holder 50, the inside of the bolt insertion holes 51 and 52 and the inside of the bolt threaded holes 53 and 54 are formed liquid-tight.

As depicted in FIG. 4, a driven sprocket wheel 41 is integrally attached to a right end portion of the intake camshaft 32, and an endless timing chain 42 extends between and around the driven sprocket wheel 41 and a driving sprocket wheel 40 provided on the crankshaft 10. Consequently, the intake camshaft 32 is rotated by rotational driving force of the crankshaft 10.

An intake cam gear 36 is attached at a substantially central portion of the intake camshaft 32 in the rightward direction such that the intake cam gear 36 rotates integrally with the intake camshaft 32. An exhaust cam gear 37 is attached integrally on the exhaust camshaft 33 such that it meshes with the intake cam gear 36. The intake cam gear 36 and the exhaust cam gear 37 have a number of teeth equal to each other. Consequently, the rotational driving force of the intake camshaft 32 which is driven to rotate by the crankshaft 10 is transmitted to the exhaust camshaft 33 through intake cams 34 and exhaust cams 35 so that the exhaust camshaft 33 is driven to rotate at the same rotational speed but in the opposite direction of rotation of the intake cam shaft 32.

As depicted in FIG. 2, an intake rocker arm 43 and an exhaust rocker arm 44 are supported for rocking motion on the cylinder head 4 by rocker arm shafts 45 extending in parallel to the intake and exhaust camshafts 32 and 33. Cam abutting portions 43*b* and 44*b* on an upper face at an end of the portions 43*a* and 44*a* of the intake and exhaust rocker arms 43 and 44 are abutted by cam faces 34*a* and 35*a* of the intake and exhaust cams 34 and 35, respectively. Consequently, valve shaft side abutting portions 43*c* and 44*c* on a lower face of an end of the arm portions 43*a* and 44*a* press the valve stems 18*a* and 19*a* of the intake and exhaust valves 18 and 19 through clearance adjustment members 29.

If the internal combustion engine 1 starts operation and the intake and exhaust camshafts 32 and 33 are rotated by rotational driving force transmitted from the crankshaft 10, then the intake and exhaust cams 34 and 35 are rotated. Consequently, the cam abutting portions 43*b* and 44*b* of the intake and exhaust rocker arms 43 and 44 are pressed in accordance with the shape of the intake and exhaust cam faces 34*a* and 35*a* of the intake and exhaust cams 34 and 35 to rock the intake and exhaust rocker arms 43 and 44. Consequently, the valve shaft side abutting portions 43*c* and 44*c* press the valve stems 18*a* and 19*a* of the intake and exhaust valves 18 and 19 through the clearance adjustment members 29 to operate the intake valves 18 and the exhaust valves 19 to open and close at a predetermined timing with a predetermined lift amount.

As depicted in FIG. 1, hereinafter a cam bearing lubrication structure 60 which supplies lubricating oil to the cam bearings 38 is described. An oil pump 7 is provided in the crankcase 2 and is driven by power of the crankshaft 10. A strainer 8 is disposed in the oil pan 6 and connected to the oil pump 7. Consequently, if the oil pump 7 is driven by the crankshaft 10, then the lubricating oil reserved in the oil pan 6 is sucked in from the strainer 8 and fed from the oil pump 7 to different locations of the internal combustion engine 1 through a supply oil path 9.

Figure 5:
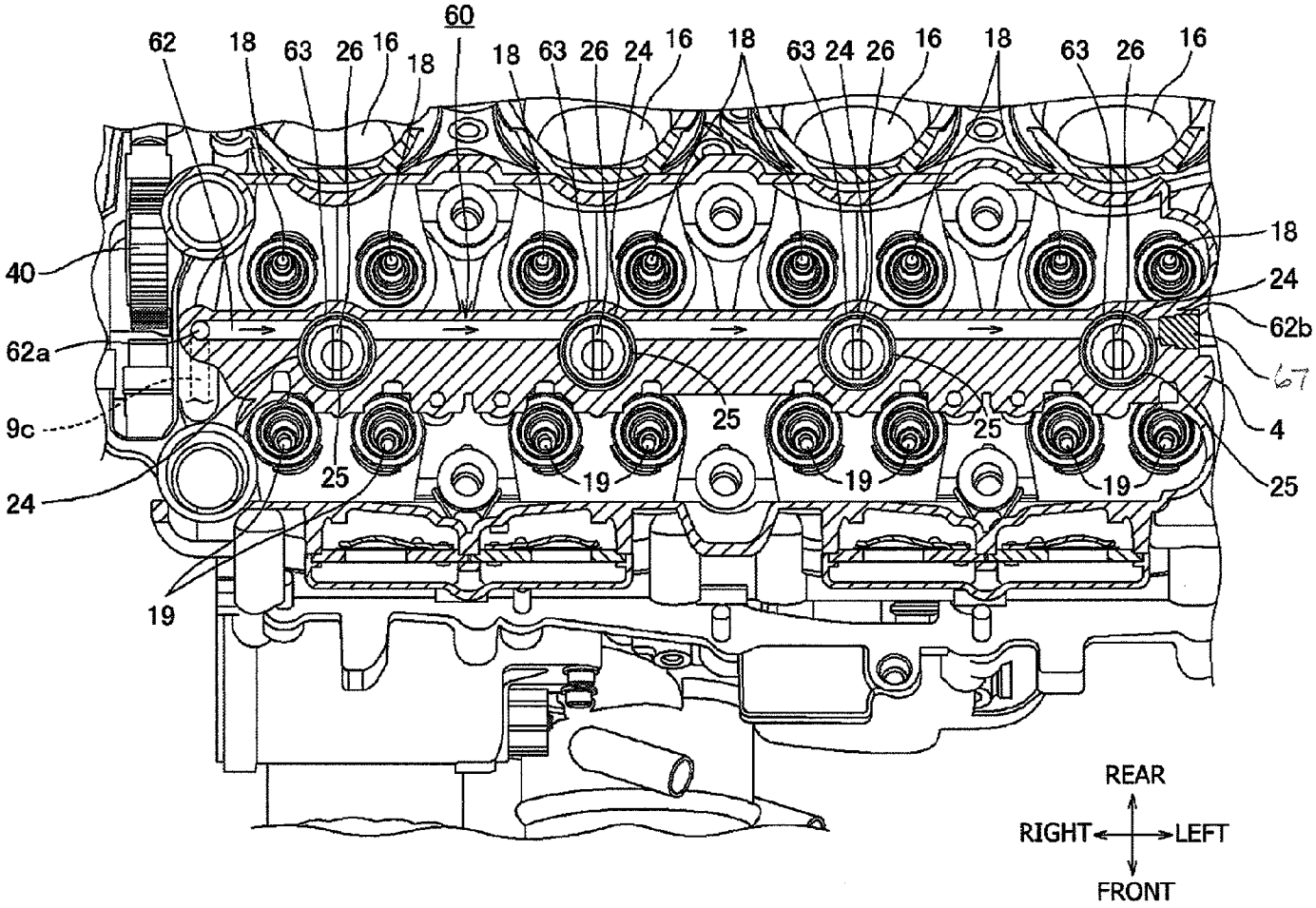
FIG. 5 is an arrow view taken along line V-V in FIG. 3.

The lubricating oil pressure fed from the oil pump 7 passes a supply oil path 9*a*, which extends to the mating plane between the crankcase 2 and the cylinder block 3 upwardly from the crankshaft 10 and passes a supply oil path 9*b* formed along the mating plane between the crankcase 2 and the cylinder block 3 toward the front of the cylinder block 3. Thereafter, the lubricating oil passes a supply oil path 9*c* formed in the cylinder head 4 from the cylinder block 3 obliquely upwardly from a front end portion of the supply oil path 9*b*, and is fed to a main lubricating oil passage 62 formed so as to be directed in the leftward and rightward direction in the cylinder head 4 as depicted in FIG. 5. A right end 62*a* of the main lubricating oil passage 62 is connected to the supply oil path 9*c*, and a left end 62*b* of the main lubricating oil passage 62 is close by a plug 67. As depicted in FIGS. 3 and 5, the main lubricating oil passage 62 is formed such that it extends through the four ignition plug holes 24 formed in the cylinder head 4.

Figure 7:
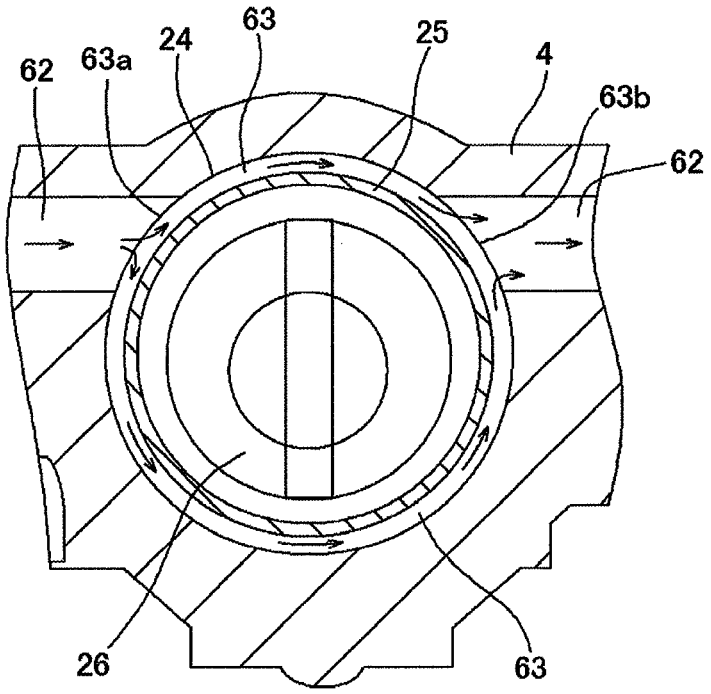
FIG. 7 is an arrow view taken along line VII-VII in FIG. 6.

As depicted in FIGS. 6 and 7, the plug tube 25 is inserted in the ignition plug hole 24. The plug tube outer periphery oil path 63 as a space configured from the inner circumferential face of the ignition plug hole 24 and the outer circumferential face of the ignition plug tube 25 is held liquid-tight at the upper end portion 25*a* and the lower end portion 25*b* of the ignition plug tube 25 by the annular seal members 27 and 28. Consequently, the inner side of the cylinder head 4 and the ignition plug hole 24 are partitioned by the ignition plug tube 25. As depicted in FIG. 7, the ignition plug hole 24 is in communication with the main lubricating oil passage 62. Therefore, the lubricating oil flowing along the main lubricating oil passage 62 on the upstream side flows into the plug tube outer periphery oil path 63 from an inlet 63*a* of the plug tube outer periphery oil path 63 and bypasses along the outer circumferential face of the ignition plug tube 25 and then flows out into the main lubricating oil passage 62 on the downstream side from an outlet 63*b* of the plug tube outer periphery oil path 63.

As depicted in FIGS. 3, 6, 8, and 9, a guide passage 64 is formed so as to extend from the plug tube outer periphery oil path 63 through the lower bearing region 38*b* formed in the cylinder head 4 toward the ignition plug hole 24 in an inclined relationship to the mating plane 59 between the camshaft holder 50 and the cylinder head 4. The guide passage 64 connects to sliding faces of the intake camshaft 32 and the bearing 38 and between the exhaust camshaft 33 and the bearing 38. An inlet 64*a* of the guide passage 64 is in communication with the plug tube outer periphery oil path 63. An outlet 64*b* to the cam bearing region 38 is provided on a semicircular face 38*c* at the ignition plug hole 24 side with respect to the center of rotation of the intake and exhaust camshafts 32 and 33.

As depicted in FIG. 6, a protuberance 25*g* is formed on the ignition plug tube 25 such that it protrudes annularly from an outer circumferential face of the intermediate portion 25*c*. The protuberance 25*g* is positioned above the inlets 64*a* of the guide passage 64 communicating with the plug tube outer periphery oil path 63 and below the upper end portion 25*a* of the ignition plug tube 25. The protuberance 25*g* promotes the flow of lubricating oil supplied to and going upwardly in the plug tube outer periphery oil path 63 into the inlet 64*a* of the guide passage 64.

Figure 9:
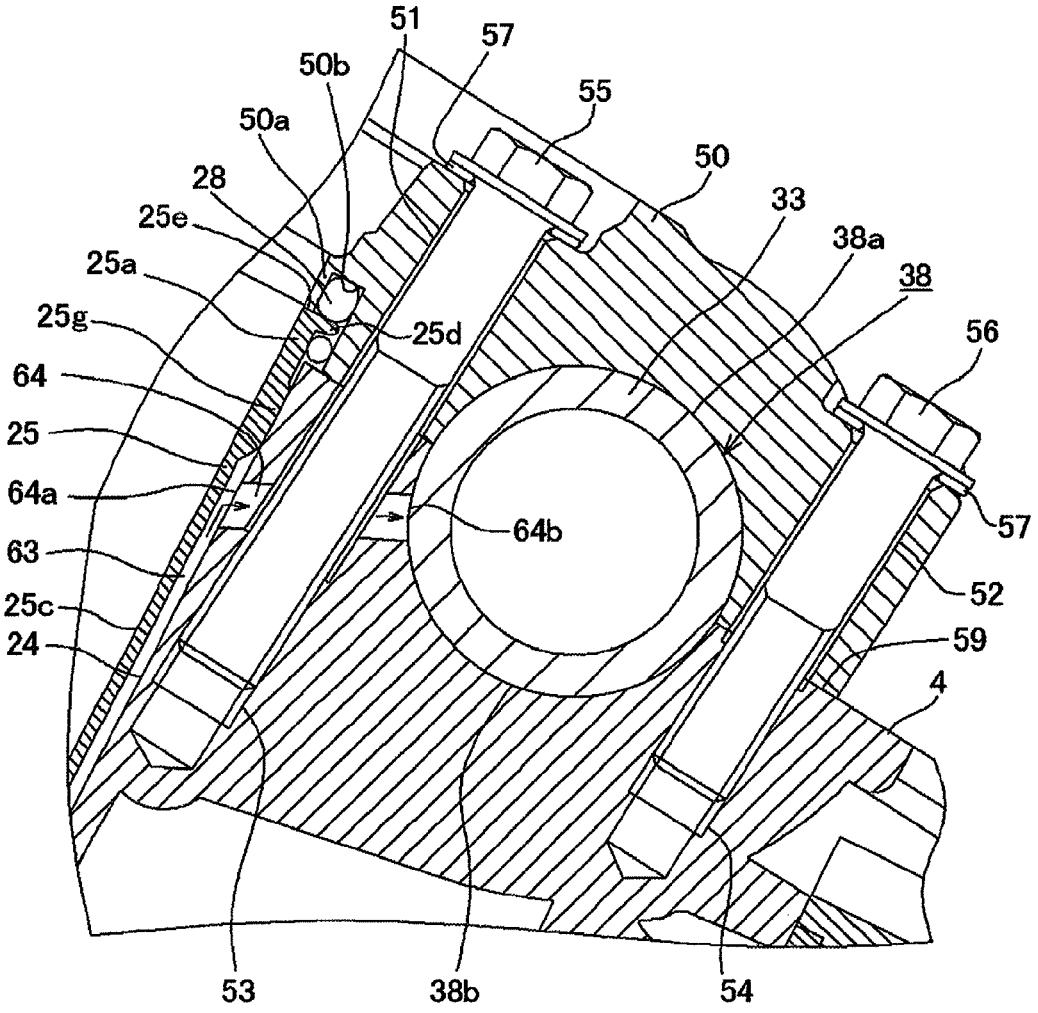
FIG. 9 is a partial enlarged sectional view of FIG. 3.

As depicted in FIGS. 8 and 9, the guide passage 64 is formed so as to extend through the bolt threaded hole 53 provided between the ignition plug hole 24 and the intake camshaft 32 or exhaust camshaft 33. The guide passage 64 is sealed by the flange bolt 55 or 56 screwed in the bolt threaded hole 53 and the annular seal member 57 so that the lubricating oil may not leak from the guide passage 64.

In the cam bearing lubrication structure 60 of the present embodiment, lubricating oil fed from the oil pump 7 passes the supply oil path 9 as depicted in FIG. 1 and is fed from the supply oil path 9 to the right end 62*a* of the main lubricating oil passage 62 and is further fed from the right end 62*a* successively to the plug tube outer periphery oil paths 63 provided in the cylinders as depicted in FIG. 5. Furthermore, as depicted in FIGS. 8 and 9, the lubricating oil flows from the plug tube outer periphery oil path 63 into the guide passage 64, passes the bolt threaded hole 53, flows out and is supplied from the outlet 64*b* formed on the semicircular face 38*c* at the plug side of the cam bearing 38 to the sliding faces of the cam bearing 38 and the intake and exhaust camshafts 32 and 33. As depicted in FIG. 8, the mating plane between the upper bearing region 38*a* and the lower bearing region 38*b* at the intake camshaft 32 side, namely, the mating plane 59 between the cylinder head 4 and the camshaft holder 50, is inclined to the ignition plug hole 24 side. Consequently, although the lubricating oil flowing from the outlet 64*b* into the cam bearing 38 is directed downwardly through the mating plane 59, it is blocked from flowing into the bolt insertion hole 51 and the bolt threaded hole 53 by the tubular member 58 fitted in the bolt insertion hole 51 and the bolt threaded hole 53. Thus, sufficient lubricating oil can be fed to the cam bearing 38.

The cam bearing lubrication structure 60 of the internal combustion engine 1 of the embodiment of the present invention is configured in such a manner as described above. Therefore, the upper and lower end portions 25*a* and 25*b* of the ignition plug tube 25 are fitted liquid-tight in the ignition plug hole 24 to form the plug tube outer periphery oil path 63 and the guide passage 64 is formed from the plug tube outer periphery oil path 63 in such a manner so as to connect the cam bearing region 38. Consequently, lubricating oil is directly supplied from the plug tube outer periphery oil path 63 to the cam bearing region 38 through the guide passage 64. Consequently, the lubricating oil passage to the cam bearing region 38 can be reduced in length, and as a result, it is possible to reduce the size of the cylinder head 4 to achieve miniaturization of the internal combustion engine 1.

Further, the inlet 63*a* of the guide passage 64 from the plug tube outer periphery oil path 63 is provided on the semicircular face 38*c* of the cam bearing region 38 at the ignition plug hole 24 side. Therefore, it is possible to reduce the length of the guide passage 64 to the utmost and reduce the time for oil supply to the cam bearing region 38 after the internal combustion engine 1 is started up.

Further, the guide passage 64 is formed so as to extend through the bolt threaded hole 53 between the intake and exhaust camshafts 32 and 33 and the ignition plug hole 24, and the guide passage 64 is sealed by the flange bolt 55. Therefore, in comparison with an alternative case in which the guide passage 64 is formed bypassing the bolt threaded hole 53, the guide passage 64 can be connected in the shortest distance. Thus, it is possible to achieve a space saving and further reduce the working cost.

Furthermore, the cam bearing 38 is formed from upper and lower halves of the upper bearing region 38*a* and the lower bearing region 38*b*, and the guide passage 64 is formed by working in an inclined relationship with respect to the mating plane 59 of the upper bearing region 38*a* and the lower bearing region 38*b* so as to be directed to the ignition plug hole 24. Therefore, when the upper and lower cam bearing regions 38*a* and 38*b* formed as two divisional upper and lower portions of the guide passage 64, the working procedure can be carried out readily by working the upper and lower cam bearing regions 38*a* and 38*b* obliquely.

Further, the cylinder head 4 is configured such that the plurality of intake and exhaust camshafts 32 and 33 are provided sandwiching the ignition plug hole 24 therebetween and the guide passages 64 are provided in a pair for each of the cam bearings 38. Therefore, the supply of lubricating oil to the cam bearings 38 at the opposite sides of the ignition plug hole 24 can be carried out from the plug tube outer periphery oil path 63 of the common ignition plug hole 24. Thus, the oil supply can be simplified.

The protuberance 25*g* is provided at a position below the upper end portion 25*a* of the ignition plug tube 25 between the position and the position of the inlet 64*a* of the guide passage 64 such that it protrudes annularly from the outer periphery of the ignition plug tube 25. Therefore, the flow of lubricating oil, which has flowed from below into and flowed upwardly in the plug tube outer periphery oil path 63 into the inlet 64*a* of the guide passage 64, can be promoted to facilitate the supply of the lubricating oil into the guide passage 64.

The camshaft holder 50 is attached in such a manner so as to press down an upper end face 25*e* of the ignition plug tube 25, which configures part of the plug tube outer periphery oil path 63, through the annular seal member 28. Therefore, the ignition plug tube 25 which is acted upon by hydraulic pressure and is likely to come off can be suppressed with certainty.

The cam bearing region is configured from the upper and lower halves formed as upward and downward divisional portions, and the holder unit is configured integrally with the upper half. When the holder unit is provided, by forming the holder unit integrally with the upper half of the cam bearing region, a reduction in the number of parts can be anticipated.

Figure 10:
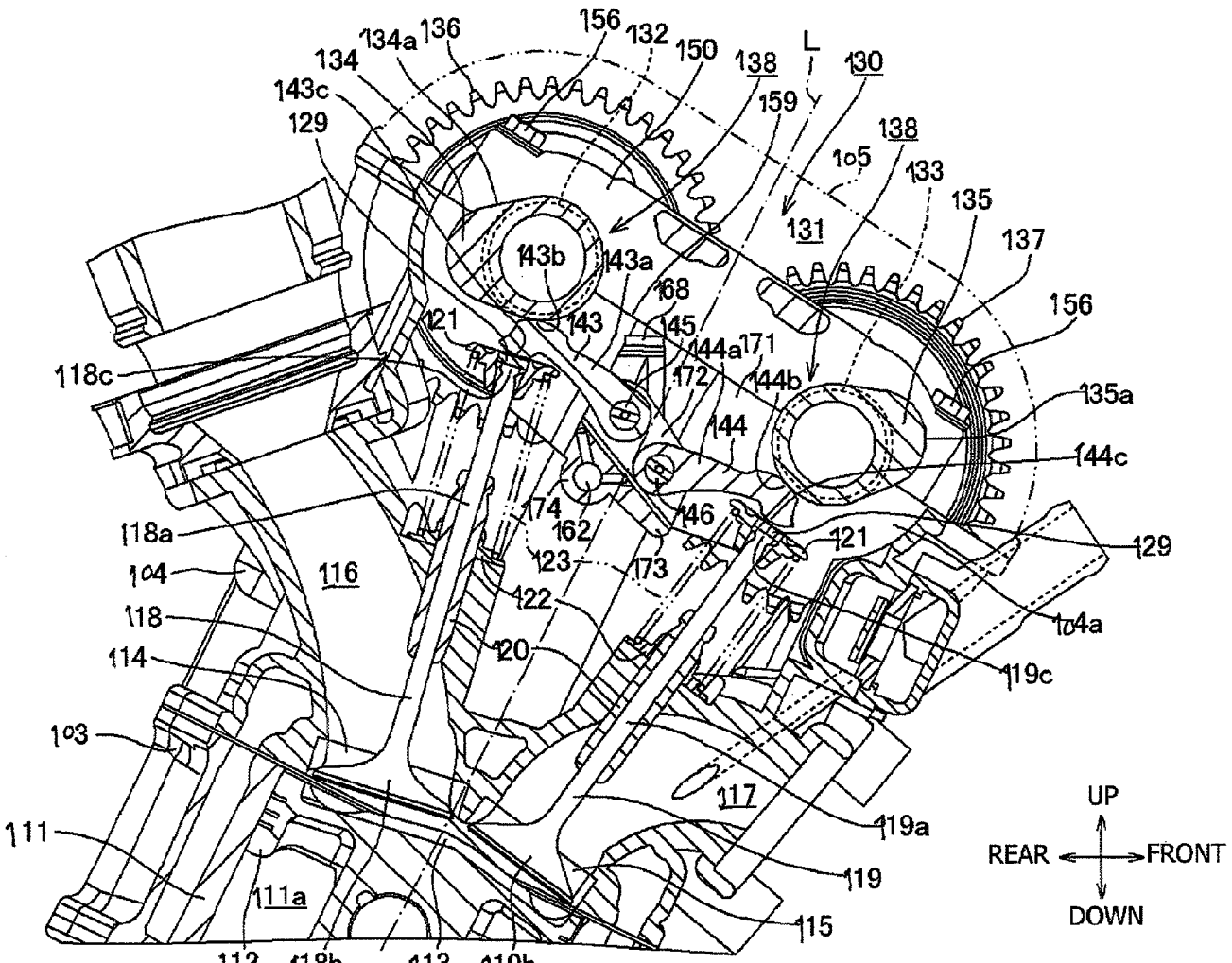
FIG. 10 is a vertical sectional view of the internal combustion engine taken along a plane passing a center line of an intake and exhaust valve.

As depicted in FIG. 10, an intake rocker arm 143 and an exhaust rocker arm 144 are supported for rocking motion on the cylinder head 104 by intake rocker arm shafts 145 and exhaust rocker arm shafts 146.

Figure 11:
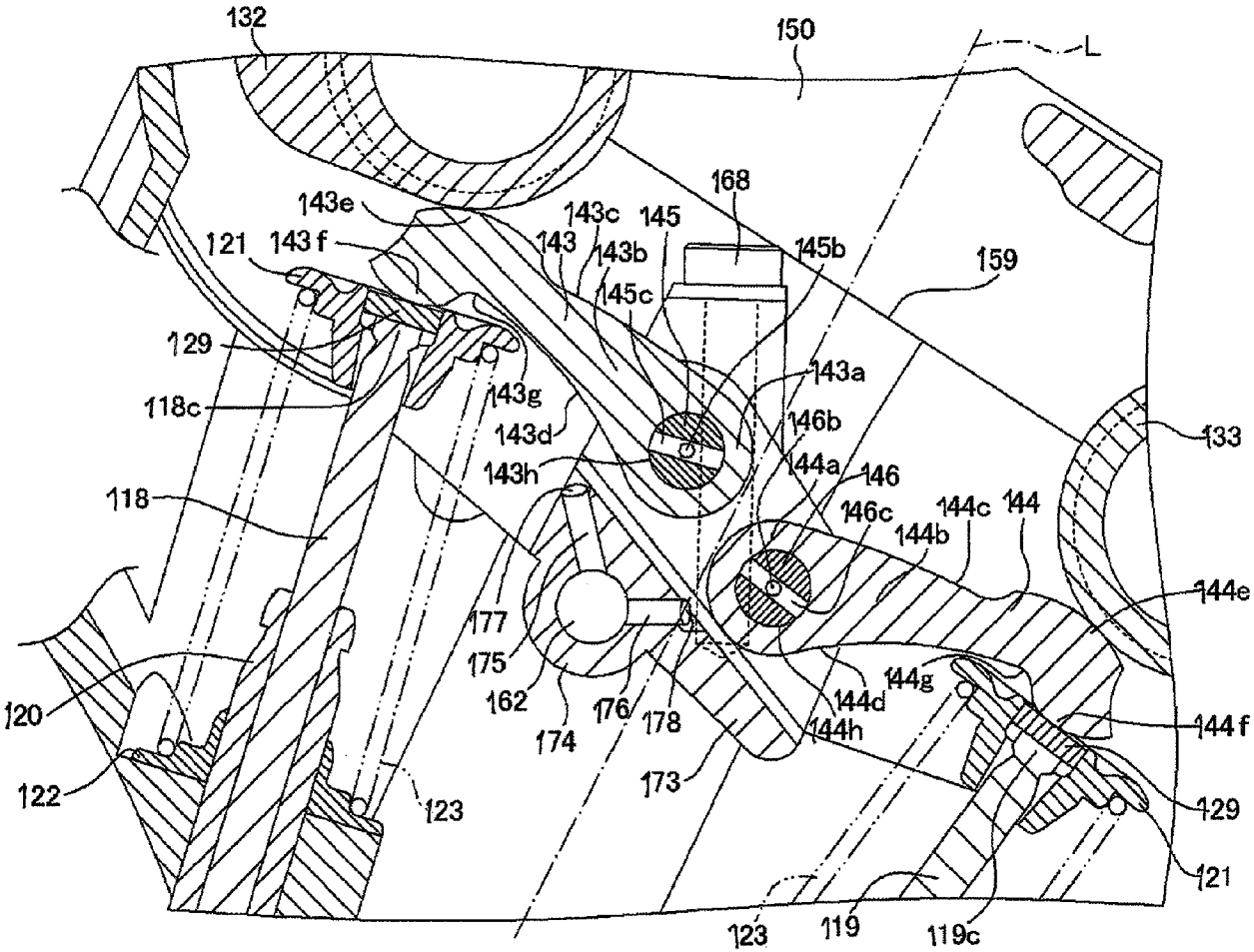
FIG. 11 is a partial enlarged sectional view of FIG. 10.
Figure 12:
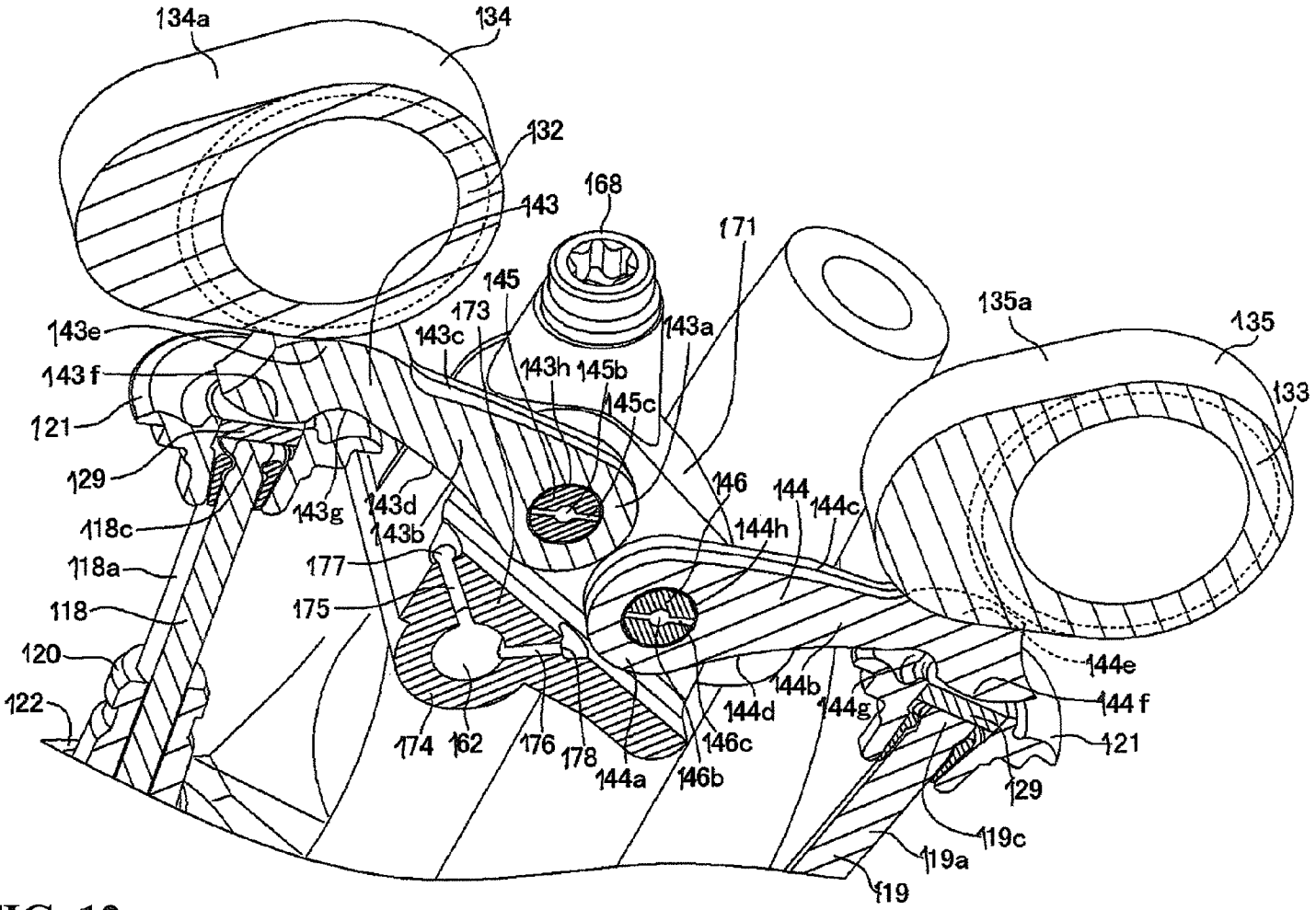
FIG. 12 is a perspective view depicting the lubricating oil supplying structure for the valve apparatus.

As depicted in FIGS. 10, 11 and 12, the intake and exhaust rocker arms 143 and 144 include pivotally supporting base portions 143*a* and 144*a* supported for pivotal motion around the intake and exhaust rocker arm shafts 145 and 146 extending therethrough, and rocking arms 143*b* and 144*b* extending from the pivotally supporting base portions 143*a* and 144*a*, respectively. Valve stem pressing portions 143*f* and 144*f* are formed on the intake and exhaust rocker arms 143 and 144 in a continuing relationship to lower faces 143*d* and 144*d* of the rocking arms 143*b* and 144*b* and press the valve stems 118*a* and 119*a* of the intake and exhaust valves 118 and 119, respectively. Further, curved recessed portions 143*g* and 144*g* are formed toward the valve stem pressing portions 143*f* and 144*f* on the lower faces 143*d* and 144*d* of the intake and exhaust rocker arms 143 and 144, respectively. When the internal combustion engine is mounted on a vehicle not depicted, the curved recessed portion 144*g* of the exhaust rocker arm 144 is positioned at the lowest position.

Sliding portions 143*e* and 144*e* are provided on upper faces 143*c* and 144*c* of the intake and exhaust rocker arms 143 and 144 so as to contact with the cam faces 134*a* and 135*a* of the intake and exhaust cams 134 and 135, respectively. Exchangeable clearance adjustment members 129 are formed as separate members from and fitted in the upper retainers 121 of the intake and exhaust valves 118 and 119 and are used to adjust the gaps between valve stem axial ends 118*c* and 119*c* and the intake and exhaust rocker arms 143 and 144, respectively. The intake and exhaust rocker arms 143 and 144 are interposed between the valve stem axial ends 118*c* and 119*c* of the intake and exhaust valves 118 and 119 and the cam faces 134*a* and 135*a* of the intake and exhaust cams 134 and 135, respectively. The sliding portions 143*e* and 144*e* of the intake and exhaust rocker arms 143 and 144 contact with the cam faces 134*a* and 135*a* to cause the valve stem pressing portions 143*f* and 144*f* to press the valve stem axial ends 118*c* and 119*c* through the clearance adjustment members 129, respectively.

As depicted in FIGS. 10, 11, 12 and 13, support walls 171 and 172 which support opposite axial end portion 145*a* and 145*b* of the rocker arm shafts 145 are formed on the cylinder head 104 and support the intake and exhaust rocker arms 143 and 144 for rocking motion thereon. The support wall 171 is provided so as to be positioned at a central position of each cylinder in the leftward and rightward direction. The ignition plug hole 124 is perforated at a central position of the support wall 171 in the leftward and rightward direction. The support walls 172 are formed in a pair on the left and right of the support wall 171. The support wall 171 and the support walls 172 are connected at lower portions thereof by a connecting bottom wall 173. A protuberance 174 is formed on a lower face 173*a* of the connecting bottom wall 173 and protrudes downwardly.

Figure 13:
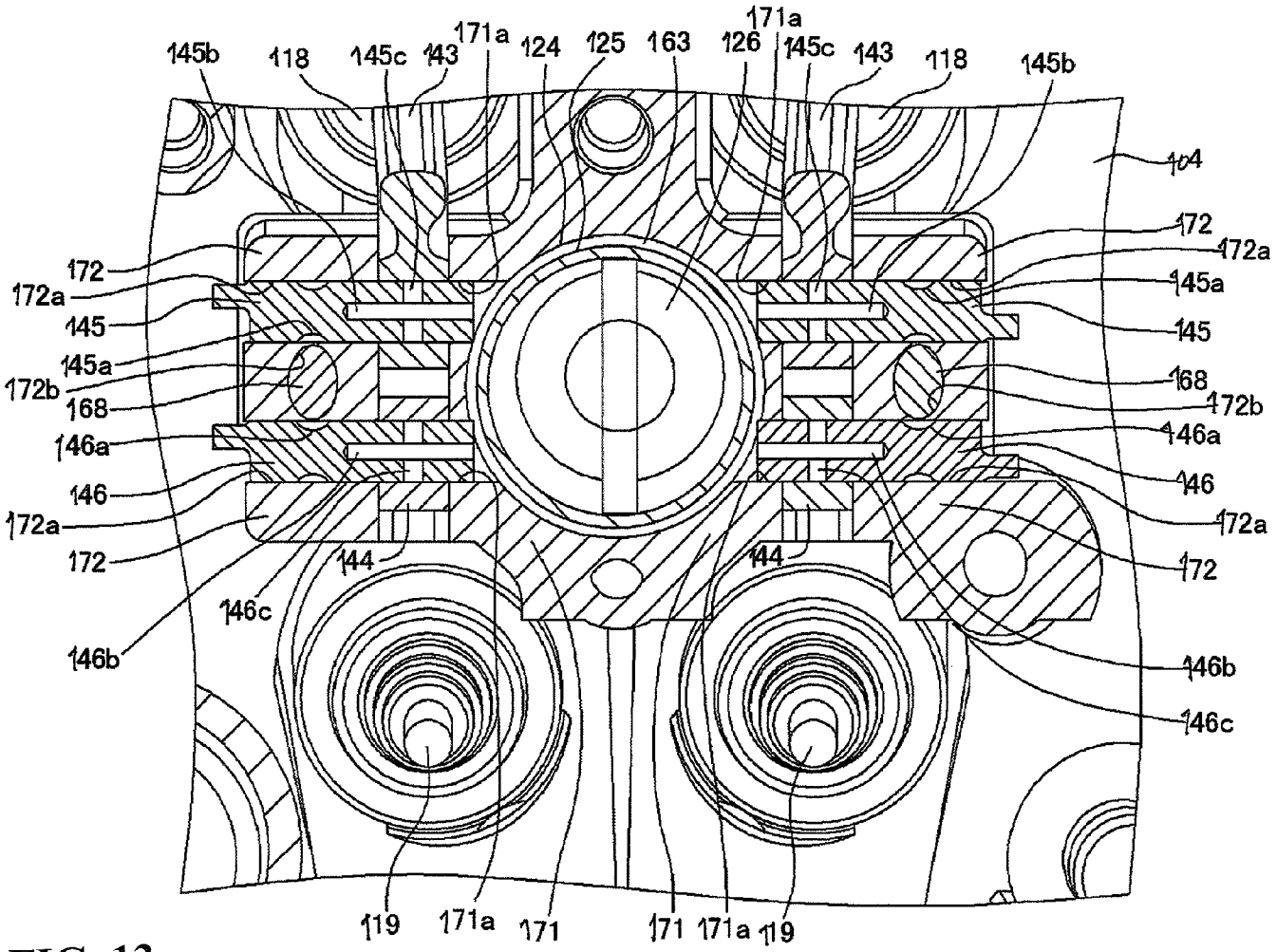
FIG. 13 is a sectional view of the internal combustion engine taken along center axial lines of an intake rocker arm shaft and an exhaust rocker arm shaft.

As depicted in FIG. 13, rocker arm shaft fitting holes 171*a* and 172*a* are provided in a leftward and rightward direction in the support walls 171 and 172 so that the intake and exhaust rocker arm shafts 145 and 146 are inserted into the rocker arm shaft fitting holes 171*a* and 172*a*. The rocker arm shaft fitting hole 171*a* of the support wall 171 is in communication with the ignition plug hole 124.

After the intake and exhaust rocker arms 143 and 144 are inserted between the support wall 171 and the support walls 172, the intake and exhaust rocker arms 143 and 144 are inserted from the rocker arm shaft fitting holes 172*a* of the support walls 172. Further, the intake and exhaust rocker arms 143 and 144 are fitted into pivotally supporting holes 143*h* and 144*h* formed in the pivotally supporting base portions 143*a* and 144*a* of the intake and exhaust rocker arms 143 and 144, respectively, and then inserted into the rocker arm shaft fitting hole 171*a* of the support wall 171. Consequently, the intake and exhaust rocker arms 143 and 144 are supported by the support walls 171 and 172.

As depicted in FIG. 11, the intake and exhaust rocker arms 143 and 144 are disposed such that the sliding portions 143*e* and 144*e* thereof are directed outwardly and disposed so as to be positioned between the intake and exhaust camshafts 132 and 133 in the forward and rearward direction.

The intake rocker arm shaft 145 and the exhaust rocker arm shaft 146 are disposed at heightwise positions different from each other with reference to an extension line L of a cylinder center axis. The cylinder 111 of the internal combustion engine is mounted in an inclined relationship with respect to the vertical direction in a state in which the internal combustion engine is mounted on a vehicle not depicted. A tip end of the intake rocker arm 143 on which one of the intake rocker arm shaft 145 and the exhaust rocker arm shaft 146 which is disposed at a higher position is directed obliquely upwardly and a tip end of the exhaust rocker arm 144 of the other one disposed at a lower position is directed obliquely downwardly.

An engaging hole 172*b* is formed in the support walls 172 into which an engaging member 168 is screwed for preventing the intake and exhaust rocker arm shafts 145 and 146 from coming off. The engaging member 168 has a male thread (not depicted) formed at a tip end thereof and is screwed with a female thread (not depicted) formed in the engaging hole 172*b*. This engaging member 168 engages with an engaging recessed portion 145*a* of the intake rocker arm shaft 145 and an engaging recessed portion 146*a* of the exhaust rocker arm shaft 146 so that coming off of the intake and exhaust rocker arm shafts 145 and 146 from the cylinder head 104 is prevented by the engaging members 168. It is to be noted that a hole having a cross section of a regular hexagonal shape is formed at a head portion of the engaging member 168 such that the engaging member 168 can be screwed by inserting a tip end portion of a tool not depicted which has a regular hexagonal shape into the hole.

If the internal combustion engine starts operation and the intake and exhaust camshafts 132 and 133 are rotated by rotational driving force transmitted from the crankshaft, then the intake and exhaust cams 134 and 135 are rotated. Consequently, the cam abutting portions 143*b* and 144*b* of the intake and exhaust rocker arms 143 and 144 are pressed in accordance with the shape of the intake and exhaust cam faces 34*a* and 35*a* of the intake and exhaust cams 134 and 135 to rock the intake and exhaust rocker arms 143 and 144. Consequently, the valve stem abutting portions 143*c* and

144*c* press the valve stems 118*a* and 119*a* of the intake and exhaust valves 118 and 119 through the clearance adjustment members 129 to operate the intake valves 118 and the exhaust valves 119 to open and close at a predetermined timing with a predetermined lift amount.

Hereinafter, a cam bearing lubrication structure which supplies lubricating oil to the cam bearings 138 of the internal combustion engine and a lubricating oil supplying structure to the valve apparatus 130 are described. As depicted in FIG. 1, an oil pump 7 is provided in the crankcase 2 and is driven by power from the crankshaft 10. A strainer 8 is disposed in the oil pan 6 and connected to the oil pump 7. Consequently, if the oil pump 7 is driven by the crankshaft 10, then the lubricating oil reserved in the oil pan 6 is sucked in from the strainer 8 and fed from the oil pump 7 to different locations of the internal combustion engine 1 through a supply oil path 9.

The lubricating oil pressure fed from the oil pump 7 passes a supply oil path 9*a*, that extends to the mating plane between the crankcase 2 and the cylinder block 3 upwardly from the crankshaft 10 and passes a supply oil path 9*b* formed along the mating plane between the crankcase 2 and the cylinder block 3 toward the front of the cylinder block 3. Thereafter, the lubricating oil passes a supply oil path 9*c* formed in the cylinder head 4 from the cylinder block 3 obliquely upwardly from a front end portion of the supply oil path 9*b*, and is fed to a main lubricating oil passage 62 formed so as to be directed in the leftward and rightward direction in the cylinder head 4 as depicted in FIG. 5.

As depicted in FIG. 10, the main lubricating oil passage 162 is formed from a single passage at a position below the intake rocker arm shaft 145 and the exhaust rocker arm shaft 46 between the intake valve 118 and the exhaust valve 119. The main lubricating oil passage 162 is formed in the protuberance 174 protruding downwardly from the connecting bottom wall 173 by which lower portions of the support wall 171 and the support walls 172 are connected to each other.

As depicted in FIG. 5, a right end 62*a* of the main lubricating oil passage 62 is connected to the supply oil path 9*c*, and a left end 62*b* of the main lubricating oil passage 62 is closed by a plug 67. As depicted in FIGS. 3 and 5, the main lubricating oil passage 62 is formed such that it extends through the four ignition plug holes 24 formed in the cylinder head 4.

As depicted in FIGS. 3 and 6, a guide passage 64 is formed so as to extend from the plug tube outer periphery oil path 63 through the lower bearing region 38*b* formed in the cylinder head 4 toward the ignition plug hole 24 in an inclined relationship to the mating plane 59 between the camshaft holder 50 and the cylinder head 4. The guide passage 64 connects to sliding faces of the intake camshaft 32 and the bearing 38 and between the exhaust camshaft 33 and the bearing 38. An inlet 64*a* of the guide passage 64 is in communication with the plug tube outer periphery oil path 63, and an outlet 64*b* to the cam bearing region 38 is provided on a semicircular face 38*c* at the ignition plug hole 24 side with respect to the center of rotation of the intake and exhaust camshafts 32 and 33.

As depicted in FIGS. 3 and 6, the guide passage 64 is formed so as to extend through the bolt threaded hole 53 provided between the ignition plug hole 24 and the intake camshaft 32 or exhaust camshaft 33. The guide passage 64 is sealed by the flange bolt 55 or 56 screwed in the bolt threaded hole 53 and the annular seal member 57 so that the lubricating oil may not leak from the guide passage 64.

As depicted in FIGS. 11 and 12, the main lubricating oil passage 162 is formed in the protuberance 174 of the connecting bottom wall 173 by which the lower portions of the paired support walls 171 and 172, which support the opposite axial ends of the intake and exhaust rocker arm shafts 45 and 46, are connected to each other. The main lubricating oil passage 162 is disposed in an offset relationship to the intake rocker arm shaft 145 disposed at the higher position with reference to the extension line L of the cylinder center axis. Further, an intake side oil injection oil path 175 and an exhaust side oil injection oil path 176 are formed in a paired relationship with each other such that they are directed independently for each of the intake rocker arms 143 and each of the exhaust rocker arms 144, respectively, from the main lubricating oil passage 162. The intake side oil injection oil path 175 and the exhaust side oil injection oil path 176 are open in the valve chamber 131 at an intake side oil injection point 177 and an exhaust side oil injection point 178, respectively.

The intake side oil injection oil path 175 is formed such that lubricating oil injected from the intake side oil injection point 177 toward the intake rocker arm 143 is directed to a tip end of the intake rocker arm 143 on the lower face 143*d* of the rocking arm 143*b* of the intake rocker arm 143. Thus, the lubricating oil injected from the intake side oil injection point 177 of the intake side oil injection oil path 175 is supplied to the valve stem pressing portion 143*f* of the intake rocker arm 143.

Meanwhile, the exhaust side oil injection oil path 176 is formed such that lubricating oil injected from the exhaust side oil injection point 178 toward the exhaust rocker arm 144 is directed to the pivotally supporting base portion 144*a* of the exhaust rocker arm 144 on the lower face 144*d* of the rocking arm 144*b* of the exhaust rocker arm 144. Thus, the lubricating oil injected from the exhaust side oil injection point 178 of the exhaust side oil injection oil path 176 is injected to the pivotally supporting base portion 144*a* of the exhaust rocker arm 144 and is supplied to the valve stem pressing portion 144*f* along the lower face 144*d* of the rocking arm 144*b*.

As depicted in FIG. 13, rocker shaft oil passages 145*b* and 146*b* are perforated in the intake and exhaust rocker arm shafts 145 and 146 so as to be directed in the longitudinal direction from the faces of the intake and exhaust rocker arm shafts 145 and 146 at the support wall 171 side, respectively. Further, the bearing oil supplying passages 145*c* and 146*c* are perforated so as to be communicated with the pivotally supporting holes 143*h* and 144*h* of the intake and exhaust rocker arms 143 and 144, respectively. The rocker shaft oil passages 145*b* and 146*b* are communicated with a plug outer periphery oil path 163 configured between the above-described ignition plug hole 124 and the ignition plug tube 125.

In the cam bearing lubrication structure 60 of the present embodiment, if the internal combustion engine 1 is started up and the oil pump 7 begins to feed lubricating oil, then the lubricating oil passes the supply oil path 9 as depicted in FIG. 1 and is fed from the supply oil path 9 to the right end 62*a* of the main lubricating oil passage 62 as depicted in FIG. 5. Then, the lubricating oil is successively fed from the right end 62*a* to the main lubricating oil passage 62 provided in each cylinder through the plug outer periphery oil path 63 provided in each cylinder.

The lubricating oil fed to the main lubricating oil passage 62 passes the intake side oil injection oil path 75 and is injected from the intake side oil injection point 77 toward the tip end of the intake rocker arm 43 on the lower face 43*d* of the rocking arm 43*b* of the intake rocker arm 43 so that it is supplied to the valve stem pressing portion 43*f* of the intake rocker arm 43. Further, the lubricating oil passes the exhaust side oil injection oil path 76 and is injected from the exhaust side oil injection point 78 toward the pivotally supporting base portion 44*a* of the exhaust rocker arm 44 on the lower face 44*d* of the rocking arm 44*b* of the exhaust rocker arm 44. Thereafter, the lubricating oil flows along the lower face 44*d* of the rocking arm 44*b* and is supplied downwardly to the valve stem pressing portion 44*f* from the curved recessed portion 44*g*.

Furthermore, the lubricating oil fed to the main lubricating oil passage 62 enters the rocker shaft oil passages 45*b* and 46*b* formed in the intake and exhaust rocker arm shafts 45 and 46 and is supplied from the bearing oil supplying passages 45*c* and 46*c* to sliding faces of the intake and exhaust rocker arm shafts 45 and 46 and the pivotally supporting holes 43*h* and 44*h* of the pivotally supporting base portions 43*a* and 44*a* of the intake and exhaust rocker arms, respectively.

The lubricating oil supplying structure 70 for the valve apparatus of the internal combustion engine 1 of the embodiment of the present invention is configured in such a manner as described above. Therefore, the main lubricating oil passage 62 is formed from a single passage extending along the intake and exhaust camshafts 32 and 33 at a position lower than the intake and exhaust rocker arm shafts 45 and 46 between the intake and exhaust valves 18 and 19, and the paired oil injection oil paths directed independently for each of the intake and exhaust rocker arms 43 and 44 from the main lubricating oil passage 62 are provided. Therefore, while the path for the injection oil is reduced in length, oil is supplied from the single intake side oil injection oil path 75 and the single exhaust side oil injection oil path 76 directly to the intake and exhaust rocker arms 43 and 44. Oil to be supplied to the intake side oil injection oil paths 75 and the exhaust side oil injection oil paths 76 is supplied from the common oil passage. Consequently, it is possible to assure the amount of oil that is supplied. Further, since the intake side oil injection oil paths 75 and the exhaust side oil injection oil paths 76 are provided from the single main lubricating oil passage 62, a space saving of the lubricating oil supplying structure 70 in the valve apparatus can be anticipated and the fabrication cost can be reduced.

Furthermore, the lower faces 43*d* and 44*d* of the rocking arms 43*b* and 44*b* of the intake and exhaust rocker arms 43 and 44 are formed continuously to the valve stem pressing portions 43*f* and 44*f*. In addition, the intake and exhaust side oil injection oil paths 75 and 76 directed to the intake and exhaust rocker arms 43 and 44 are formed such that they are directed to the lower faces 43*d* and 44*d* of the rocking arms 43*b* and 44*b*, respectively. Consequently, even if part of the injected oil does not directly reach the valve stem pressing portions 43*f* and 44*f*, it flows along the lower faces 43*d* and 44*d* of the rocking arms 43*b* and 44*b* and is supplied to the valve stem pressing portions 43*f* and 44*f* so that the oil supplying amount to the valve stem pressing portions 43*f* and 44*f* can be increased.

Further, since the lower face 44*d* of the exhaust rocker arm 44 is formed on the curved recessed portion 44*g* which is the lowest portion toward the valve stem pressing portion 44*f*, oil sticking to the lower face 44*d* can positively flow to the sliding portion 44*e* side between the valve stem pressing portion 44*f* and the exhaust valve stem axial end 19*c* to collect the oil.

Furthermore, the clearance adjustment members 29 are disposed as separate members between the valve stem pressing portions 43*f* and 44*f* of intake and exhaust rocker arms 43 and 44 and the intake and exhaust valve stem axial ends 18*c* and 19*c*. Therefore, the necessity for such a screw adjustment mechanism disposed at a tip end of a rocker arm as in a conventional technology is eliminated. Further, since the sliding faces of the valve stem pressing portions 43*f* and 44*f* are configured from curved faces, it becomes possible to supply oil flowing along the lower faces 43*d* and 44*d* of the intake and exhaust rocker arms 43 and 44 with certainty to the sliding faces of the valve stem pressing portions 43*f* and 44*f*, respectively.

Further, the main lubricating oil passage 62 is provided on the connecting bottom wall 73 between the paired support walls 71 and 72 which support the opposite axial ends of the intake and exhaust rocker arm shafts 45 and 46 and is provided in the protuberance 74 which protrudes from the lower face of the connecting bottom wall 73. Consequently, the main lubricating oil passage 62 is provided in the cylinder head 4. Thus, an increase in size of the cylinder head 4 in the heightwise direction can be suppressed.

Furthermore, the sliding portions 43*e* and 44*e* are disposed on the upper faces 43*c* and 44*c* of the intake and exhaust rocker arms 43 and 44, respectively. Consequently, the injected oil can be supplied to the intake and exhaust valve stem axial ends 18*c* and 19*c* without being obstructed by the cam lobes of the intake and exhaust cams 34 and 35 of the intake and exhaust camshafts 32 and 33, respectively.

Where the intake and exhaust rocker arm shafts 45 and 46 are disposed closely to each other, they are disposed in an offset relationship from each other in the cylinder axial line direction and the main lubricating oil passage 62 is disposed in an offset relationship to the intake rocker arm shaft 45 side which is disposed at the higher position. Therefore, the free space can be utilized effectively to dispose the main lubricating oil passage 62 compactly.

The internal combustion engine 1 is mounted on the vehicle such that the tip ends of the intake rocker arm 43 and the exhaust rocker arm 44 are directed obliquely upwardly and obliquely downwardly, respectively. The intake side oil injection oil path 75 to the intake rocker arm 43, disposed at the higher position, is formed such that it is directed toward the tip end of the intake rocker arm 43 while the exhaust side oil injection oil path 76 to the exhaust rocker arm 44 disposed at the lower position is formed such that it is directed to the pivotally supporting base portion 44*a* of the exhaust rocker arm 44. Therefore, even where it is difficult to direct an oil injection oil path directly to the tip end of the exhaust rocker arm 44 like the exhaust side oil injection oil path 76, it is possible to allow oil to flow and be supplied to the tip end of the exhaust rocker arm 44 from the pivotally supporting base portion 44*a* of the exhaust rocker arm 44. Consequently, while a reduction in the length of the exhaust side oil injection oil path 76 is achieved, oil supply can be carried out with certainty.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cam bearing lubrication structure for an internal combustion engine comprising:

a cylinder head having a cam bearing region for supporting a camshaft for rotation;

a plug hole in which an ignition plug supported on the cylinder head is accommodated such that an end thereof is exposed to a combustion chamber;

a plug tube having a cylindrical shape and fitted liquid-tight at an upper end portion in the plug hole and fitted liquid-tight at a lower end portion in the plug hole to separate the inside of the cylinder head and the plug hole from each other, said plug tube extending continuously from the upper end portion in the plug hole to the lower end portion in the plug hole;

an outer periphery oil path formed liquid-tight at the upper and lower end portions of the plug tube with respect to the plug hole and bypassing along an outer peripheral face of the plug tube from substantially the upper end portion in the plug hole to the lower end portion in the plug hole;

a main lubricating oil passage extending through the plug hole in the cylinder head and formed for connecting to the outer periphery oil path; and a guide passage formed in and through the cam bearing region for connecting a sliding face of the cam bearing region from the outer periphery oil path and supplying lubricating oil to a sliding face of the cam bearing region and the camshaft; and a protuberance provided at a position below an upper end face of the plug tube and between the position below the upper end face and a position of an inlet of the guide passage in such a manner so as to protrude annularly from an outer periphery of the plug tube, said protuberance promotes the flow of lubricating oil supplied to and moving upwardly in the plug tube outer periphery oil path and into the inlet of the guide passage.

2. The cam bearing lubrication structure for the internal combustion engine according to claim 1, wherein an outlet of the guide passage to the cam bearing region is provided on a semicircular face at the plug hole side with respect to the center of rotation of the camshaft.

3. The cam bearing lubrication structure for the internal combustion engine according to claim 2, wherein the cam bearing region is configured from a plurality of divisional halves, and a threaded hole provided between the camshaft and the plug hole and used for a fastening member which couples the divisional halve is formed such that the guide passage extends therethrough, and the threaded hole is sealed by the fastening member.

4. The cam bearing lubrication structure for the internal combustion engine according to claim 3, wherein the cam bearing region is configured from divisional upper and lower halves, and the guide passage is formed by working in such a manner as to be inclined with respect to a mating plane of the upper and lower halves toward the plug hole.

5. The cam bearing lubrication structure for the internal combustion engine according to claim 1, wherein the cylinder head has a plurality of camshafts provided thereon sandwiching the plug hole therebetween, and a pair of guide passages are formed for each of the cam bearing regions.

6. The cam bearing lubrication structure for the internal combustion engine according to claim 2, wherein the cylinder head has a plurality of camshafts provided thereon sandwiching the plug hole therebetween, and a pair of guide passages are formed for each of the cam bearing regions.

7. The cam bearing lubrication structure for the internal combustion engine according to claim 3, wherein the cylinder head has a plurality of camshafts provided thereon sandwiching the plug hole therebetween, and a pair of guide passages are formed for each of the cam bearing regions.

8. The cam bearing lubrication structure for the internal combustion engine according to claim 4, wherein the cylinder head has a plurality of camshafts provided thereon sandwiching the plug hole therebetween, and a pair of guide passages are formed for each of the cam bearing regions.

9. The cam bearing lubrication structure for the internal combustion engine according to claim 1, wherein a holder unit is disposed at an upper end face of the upper end portion of the plug tube so as to closely contact with the upper end face to fix the plug tube from coming off from above with an annular seal member interposed therebetween.

10. The cam bearing lubrication structure for the internal combustion engine according to claim 9, wherein the cam bearing region is configured from upper and lower halves formed as upper and lower divisional portions, and the holder unit is configured integrally with the upper half.

11. A lubricating oil supplying structure for a valve apparatus of an internal combustion engine having a cylinder head which supports camshafts for rotation thereon, the lubricating oil supplying structure including:

for each pair of engine valves for intake and exhaust, rocker arms supported at pivotally supporting base portions thereof for rocking motion by rocker arm shafts, the rocker arms being interposed between valve stem axial ends of the engine valves and cam faces of the camshafts to allow contact therebetween, pressing force from the cam faces acting upon the rocking arms and being transmitted to the valve stems to open and close the engine valves, the lubricating oil supplying structure for the valve apparatus of the internal combustion engine comprising:

an oil passage provided in the cylinder head along an axial direction of the camshafts and formed from a single passage at a position lower than the rocker arm shafts between the engine valves, said oil passage being provided in a protuberance protruding from a lower face of a connecting bottom wall which interconnects lower portions of a pair of support walls which are provided on the cylinder head and support the opposite axial ends of the rocker arm shaft; and a pair of oil injection oil paths formed so as to be directed independently for the individual rocker arms from the oil passage.

12. The lubricating oil supplying structure for the valve apparatus according to claim 11, further comprising:

valve stem pressing portions formed at locations at which the rocker arms contact with the valve stems side in a continuous relationship to lower faces of the rocking arms of the rocker arms; and the direction in which the oil injection oil paths are directed to the rocker arms being directed toward the lower faces of the rocking arms.

13. The lubricating oil supplying structure for the valve apparatus according to claim 12, wherein the lower face of the rocker arm is formed as a curved recessed portion being the lowest portion toward the valve stem pressing portion.

14. The lubricating oil supplying structure for the valve apparatus according to claim 13, wherein clearance adjustment members for adjusting gaps between the valve stem axial ends and the rocker arms are formed exchangeably as separate members between the valve stems and the valve stem pressing portions of the rocker arms.

15. The lubricating oil supplying structure for the valve apparatus according to claim 11, wherein the camshafts are configured independently as an intake camshaft and an exhaust camshaft and disposed at a position above the rocker arms, and sliding portions between the rocker arms and the cam faces are provided on upper faces of the rocker arms.

16. The lubricating oil supplying structure for the valve apparatus according to claim 15, wherein the rocker arm shafts are disposed between the intake and exhaust camshafts such that the sliding portions of the rocker arms are disposed to be directed outwardly relative to each other;

the rocker arm shafts are disposed at heightwise positions different from each other with reference to an extension line of the cylinder center axis; and the oil passage is disposed in an offset relationship to the rocker arm shaft disposed at the higher position.

17. The lubricating oil supplying structure for the valve apparatus according to claim 16, wherein a cylinder of the internal combustion engine is mounted in an inclined relationship with respect to the vertical direction such that, in a state in which the internal combustion engine is mounted on a vehicle, a tip end of the rocker arm disposed on one of the two rocker arm shafts which is disposed at the higher position is directed obliquely upwardly while a tip end of the rocker arm disposed on the other one of the two rocker arm shafts which is disposed at the lower position is directed obliquely downwardly;

the oil injection oil path is formed such that the injection direction from the oil injection oil path to the valve stem pressing portion of that one of the rocker arms in which the oil passage is disposed in an offset relationship is directed to the tip end of the rocker arm, and the oil injection oil path is formed such that the injection direction from the oil injection oil path to the valve stem pressing portion of the other rocker arm is directed to the pivotally supporting base portion of the rocker arm.

* * * * *